US011055966B2

(12) United States Patent
Sanborn et al.

(10) Patent No.: US 11,055,966 B2
(45) Date of Patent: Jul. 6, 2021

(54) REEL GROWTH AND AWARD ENHANCEMENT TRIGGERS

(71) Applicant: Aristocrat Technologies, Inc., Las Vegas, NV (US)

(72) Inventors: Hanna Sanborn, Pflugerville, TX (US); Chad La Guardia, Austin, TX (US); Erick Ching, Cedar Park, TX (US); Jennifer Mizzi, Reno, NV (US); Rogelio Decasa, Jr., Renton, WA (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 16/679,174

(22) Filed: Nov. 9, 2019

(65) Prior Publication Data

US 2021/0142622 A1 May 13, 2021

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
None
See application file for complete search history.

(56) References Cited

U.S. PATENT DOCUMENTS 8,460,089 B2 * 6/2013 Pires ..... G07F 17/3258 463/23
9,679,444 B2 * 6/2017 Ryan ..... G07F 17/3244
10,102,710 B2 * 10/2018 Boese ..... G07F 17/3213
10,255,751 B2 * 4/2019 Boese ..... G07F 17/326
10,546,452 B2 * 1/2020 Kennedy ..... G07F 17/3265
2002/0025848 A1 2/2002 Graham
2005/0159208 A1 * 7/2005 Pacey ..... G07F 17/3211 463/20
2006/0247002 A1 * 11/2006 Yoshimi ..... G07F 17/34 463/20

(Continued)

OTHER PUBLICATIONS

International Search Report and Written Opinion for App. No. PCT/US2020/027520, dated Jun. 25, 2020, 13 pages.

(Continued)

*Primary Examiner* — Seng H Lim
(74) *Attorney, Agent, or Firm* — Weaver Austin Villeneuve & Sampson LLP

(57) ABSTRACT

According to some implementations, when an expansion trigger symbol lands in a defined area of a slot game display during an instance of a slot game, at least one additional active display symbol position will be presented in a display symbol row or a display symbol column in which the expansion trigger symbol is displayed. The defined area may correspond to some or all of the active display symbol positions, depending on the particular implementation. In some instances, an award enhancement trigger symbol may be presented in at least one of the active display symbol positions, e.g., in the same display symbol row or display symbol column in which the expansion trigger symbol is or was displayed. One or more enhanced award symbols may be presented in a row or column of active display symbol positions in which the award enhancement trigger symbol is presented.

23 Claims, 17 Drawing Sheets

(56) References Cited

U.S. PATENT DOCUMENTS

2007/0060245 A1* 3/2007 Veenker ..... G07F 17/3267 463/16
2007/0060261 A1 3/2007 Gomez
2010/0016061 A1* 1/2010 Gomez ..... G07F 17/34 463/20
2012/0064961 A1 3/2012 Vancura
2013/0102375 A1* 4/2013 Aoki ..... G07F 17/32 463/20
2013/0157741 A1* 6/2013 Pacey ..... G07F 17/34 463/20
2013/0231174 A1* 9/2013 Fujisawa ..... G07F 17/326 463/20
2013/0252708 A1* 9/2013 Englman ..... G07F 17/32 463/20
2014/0228091 A1* 8/2014 Berman ..... G07F 17/3244 463/20
2014/0309015 A1 10/2014 Aoki et al.
2015/0348355 A1* 12/2015 Caputo ..... G07F 17/3267 463/31
2015/0363998 A1* 12/2015 Comeau ..... G07F 17/34 463/20
2017/0024955 A1 1/2017 Pawloski et al.
2019/0051097 A1 2/2019 Marks
2020/0105090 A1* 4/2020 Caputo ..... G07F 17/3213
2020/0250923 A1* 8/2020 Ceniceroz ..... G07F 17/3244

OTHER PUBLICATIONS

Harrigan et al., "PAR Sheets, probabilities, and slot machine play: Implications for problem and non-problem gambling." In: Journal of Gambling Issues. Jun. 2009 (May 2009) Retrieved on Jun. 4, 2020 (Jun. 4, 2020) from <https://jgi.camh.net/index.php/jgi/article/download/3811/3826>.

* cited by examiner

REEL GROWTH AND AWARD ENHANCEMENT TRIGGERS

BACKGROUND

Electronic gaming machines ("EGMs") or gaming devices provide a variety of wagering games such as slot games, video poker games, video blackjack games, roulette games, video bingo games, keno games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical wagering games use a random number generator (RNG) to randomly determine the outcome of each game. The wagering game is designed to return a certain percentage of the amount wagered back to the player (RTP=return to player) over the course of many plays or instances of the game. The RTP and randomness of the RNG are critical to ensuring the fairness of the games and are, therefore, highly regulated. Upon initiation of play, the RNG randomly determines a game outcome and symbols are then selected which correspond to that outcome. Notably, some games may include an element of skill on the part of the player and are, therefore, not entirely random.

In existing gaming systems, feature games, secondary or bonus games, may be triggered for players in addition to the base game. A feature game gives players an additional opportunity to win prizes, or the opportunity to win larger prizes, than would otherwise be available in the base game. Feature games can also offer altered game play to enhance player enjoyment.

The popularity of such gaming machines with players is heavily dependent on the entertainment value of the machine relative to other gaming options and the player's gambling experience. Operators of gaming businesses therefore strive to provide the most entertaining, engaging, and exciting machines to attract customers to use the machines while also providing a machine that allows the player to enjoy their gambling experience. Accordingly, there is a continuing need for gaming machine manufacturers to develop new games in order to maintain or increase player enjoyment.

SUMMARY

One innovative aspect of the subject matter described in this disclosure may be implemented in an apparatus. The apparatus may include an interface system, a display system and a control system. In some examples, the apparatus may be a gaming device. The interface system may include at least one user interface configured for receiving an indication to initiate one or more instances of a game, such as a slot game.

The control system may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. According to some examples, the control system may be configured for controlling the gaming device to present one or more instances of a slot game.

In some implementations, presenting the one or more instances of the slot game may involve determining a slot game outcome and corresponding display symbols. The display symbols may be selected from a symbol set that includes expansion trigger symbols and award enhancement trigger symbols. Presenting the one or more instances of the slot game may involve controlling the display system to display selected display symbols for the slot game outcome at a plurality of display symbol positions on a display device of the display system. In some examples, the display symbol positions may be arranged in a plurality of active display symbol rows and a plurality of active display symbol columns. At least one of the selected display symbols may, in some instances, be an expansion trigger symbol.

Presenting the one or more instances of the slot game may involve controlling the display system to present at least one additional active display symbol position in a display symbol row and/or a display symbol column in which the expansion trigger symbol is displayed. Presenting the one or more instances of the slot game may involve controlling the display system to present an award enhancement trigger symbol in at least one of the active display symbol positions and controlling the display system to present one or more enhanced award symbols in a row or column of active display symbol positions in which the award enhancement trigger symbol is presented.

According to some examples, the one or more enhanced award symbols may include one or more bonus game trigger symbols. In some instances, the one or more enhanced award symbols may include one or more wild symbols. The one or more wilds symbols may include persistent wild symbols. In some examples, the one or more enhanced award symbols may include one or more award multiplier symbols. The one or more award multiplier symbols may include persistent multiplier symbols. In some instances, the one or more enhanced award symbols may include at least one wild symbol and at least one award multiplier symbol.

According to some examples, the one or more enhanced award symbols may include one or more prize on symbols. The one or more prize on symbols may include one or more credit award prize symbols. The one or more prize on symbols may include one or more jackpot award symbols.

In some instances, presenting the one or more enhanced award symbols may involve moving one or more display symbols in a row or column in which the award enhancement trigger symbol is presented, to reveal the one or more enhanced award symbols. According to some examples, the award enhancement trigger symbol may be presented in the display symbol row or the display symbol column in which the expansion trigger symbol is displayed. In some instances, when the display system is controlled to present an award enhancement symbol in at least one of the active display symbol positions, the award enhancement symbol may be presented in at least one of the additional active display symbol positions.

In some implementations, presenting the award enhancement trigger symbol may involve replacing the expansion trigger symbol with the award enhancement trigger symbol. In some instances, the expansion trigger symbol and/or the award enhancement trigger symbol may be a wild symbol. According to some examples, the expansion trigger symbol and/or the award enhancement trigger symbol may be an award multiplier symbol. In some examples, the expansion trigger symbol and/or the award enhancement trigger symbol may be a prize on symbol.

In some instances, at least one additional active display symbol position may be presented in a display symbol row and at least one additional active display symbol position may be presented in a display symbol column in which the expansion trigger symbol is displayed. In some examples, an award enhancement trigger symbol may be displayed in at least one additional active display symbol position in the display symbol row and an award enhancement trigger symbol may be displayed in at least one additional active display symbol position in the display symbol column. According to some examples, presenting the one or more enhanced award symbols may involve moving one or more display symbols in the display symbol row and in the display symbol column in which the award enhancement trigger symbol is presented, to reveal the one or more enhanced award symbols. The one or more enhanced award symbols presented in the display symbol row may include at least one award multiplier symbol and the one or more enhanced award symbols presented in the display symbol column may include at least one wild symbol.

Still other innovative aspects of the subject matter described in this disclosure can be implemented in a gaming method. The method may involve controlling a gaming device to present one or more instances of a slot game.

In some implementations, presenting the one or more instances of the slot game may involve determining a slot game outcome and corresponding display symbols. The display symbols may be selected from a symbol set that includes expansion trigger symbols and award enhancement trigger symbols. Presenting the one or more instances of the slot game may involve controlling a display system of the gaming device to display selected display symbols for the slot game outcome at a plurality of display symbol positions on a display device of the display system. In some examples, the display symbol positions may be arranged in a plurality of active display symbol rows and a plurality of active display symbol columns. At least one of the selected display symbols may, in some instances, be an expansion trigger symbol.

Presenting the one or more instances of the slot game may involve controlling the display system to present at least one additional active display symbol position in a display symbol row and/or a display symbol column in which the expansion trigger symbol is displayed. Presenting the one or more instances of the slot game may involve controlling the display system to present an award enhancement trigger symbol in at least one of the active display symbol positions and controlling the display system to present one or more enhanced award symbols in a row or column of active display symbol positions in which the award enhancement trigger symbol is presented.

According to some examples, the one or more enhanced award symbols may include one or more bonus game trigger symbols. In some instances, the one or more enhanced award symbols may include one or more wild symbols. The one or more wilds symbols may include persistent wild symbols. In some examples, the one or more enhanced award symbols may include one or more award multiplier symbols. The one or more award multiplier symbols may include persistent multiplier symbols. In some instances, the one or more enhanced award symbols may include at least one wild symbol and at least one award multiplier symbol.

According to some examples, the one or more enhanced award symbols may include one or more prize on symbols. The one or more prize on symbols may include one or more credit award prize symbols. The one or more prize on symbols may include one or more jackpot award symbols.

In some instances, presenting the one or more enhanced award symbols may involve moving one or more display symbols in a row or column in which the award enhancement trigger symbol is presented, to reveal the one or more enhanced award symbols. According to some examples, the award enhancement trigger symbol may be presented in the display symbol row or the display symbol column in which the expansion trigger symbol is displayed. In some instances, when the display system is controlled to present an award enhancement symbol in at least one of the active display symbol positions, the award enhancement symbol may be presented in at least one of the additional active display symbol positions.

In some implementations, presenting the award enhancement trigger symbol may involve replacing the expansion trigger symbol with the award enhancement trigger symbol. In some instances, the expansion trigger symbol and/or the award enhancement trigger symbol may be a wild symbol. According to some examples, the expansion trigger symbol and/or the award enhancement trigger symbol may be an award multiplier symbol. In some examples, the expansion trigger symbol and/or the award enhancement trigger symbol may be a prize on symbol.

In some instances, at least one additional active display symbol position may be presented in a display symbol row and at least one additional active display symbol position may be presented in a display symbol column in which the expansion trigger symbol is displayed. In some examples, an award enhancement trigger symbol may be displayed in at least one additional active display symbol position in the display symbol row and an award enhancement trigger symbol may be displayed in at least one additional active display symbol position in the display symbol column. According to some examples, presenting the one or more enhanced award symbols may involve moving one or more display symbols in the display symbol row and in the display symbol column in which the award enhancement trigger symbol is presented, to reveal the one or more enhanced award symbols. The one or more enhanced award symbols presented in the display symbol row may include at least one award multiplier symbol and the one or more enhanced award symbols presented in the display symbol column may include at least one wild symbol.

Some or all of the operations, functions and/or methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in one or more non-transitory media having software stored thereon.

For example, the software may include instructions for controlling one or more devices to perform a gaming method. In some examples, the method may involve controlling a gaming device to present one or more instances of a slot game.

In some implementations, presenting the one or more instances of the slot game may involve determining a slot game outcome and corresponding display symbols. The display symbols may be selected from a symbol set that includes expansion trigger symbols and award enhancement trigger symbols. Presenting the one or more instances of the slot game may involve controlling a display system of the gaming device to display selected display symbols for the slot game outcome at a plurality of display symbol positions on a display device of the display system. In some examples, the display symbol positions may be arranged in a plurality of active display symbol rows and a plurality of active display symbol columns. At least one of the selected display symbols may, in some instances, be an expansion trigger symbol.

Presenting the one or more instances of the slot game may involve controlling the display system to present at least one additional active display symbol position in a display symbol row and/or a display symbol column in which the expansion trigger symbol is displayed. Presenting the one or more instances of the slot game may involve controlling the display system to present an award enhancement trigger symbol in at least one of the active display symbol positions and controlling the display system to present one or more enhanced award symbols in a row or column of active display symbol positions in which the award enhancement trigger symbol is presented.

According to some examples, the one or more enhanced award symbols may include one or more bonus game trigger symbols. In some instances, the one or more enhanced award symbols may include one or more wild symbols. The one or more wilds symbols may include persistent wild symbols. In some examples, the one or more enhanced award symbols may include one or more award multiplier symbols. The one or more award multiplier symbols may include persistent multiplier symbols. In some instances, the one or more enhanced award symbols may include at least one wild symbol and at least one award multiplier symbol.

According to some examples, the one or more enhanced award symbols may include one or more prize on symbols. The one or more prize on symbols may include one or more credit award prize symbols. The one or more prize on symbols may include one or more jackpot award symbols.

In some instances, presenting the one or more enhanced award symbols may involve moving one or more display symbols in a row or column in which the award enhancement trigger symbol is presented, to reveal the one or more enhanced award symbols. According to some examples, the award enhancement trigger symbol may be presented in the display symbol row or the display symbol column in which the expansion trigger symbol is displayed. In some instances, when the display system is controlled to present an award enhancement symbol in at least one of the active display symbol positions, the award enhancement symbol may be presented in at least one of the additional active display symbol positions.

In some implementations, presenting the award enhancement trigger symbol may involve replacing the expansion trigger symbol with the award enhancement trigger symbol. In some instances, the expansion trigger symbol and/or the award enhancement trigger symbol may be a wild symbol. According to some examples, the expansion trigger symbol and/or the award enhancement trigger symbol may be an award multiplier symbol. In some examples, the expansion trigger symbol and/or the award enhancement trigger symbol may be a prize on symbol.

In some instances, at least one additional active display symbol position may be presented in a display symbol row and at least one additional active display symbol position may be presented in a display symbol column in which the expansion trigger symbol is displayed. In some examples, an award enhancement trigger symbol may be displayed in at least one additional active display symbol position in the display symbol row and an award enhancement trigger symbol may be displayed in at least one additional active display symbol position in the display symbol column. According to some examples, presenting the one or more enhanced award symbols may involve moving one or more display symbols in the display symbol row and in the display symbol column in which the award enhancement trigger symbol is presented, to reveal the one or more enhanced award symbols. The one or more enhanced award symbols presented in the display symbol row may include at least one award multiplier symbol and the one or more enhanced award symbols presented in the display symbol column may include at least one wild symbol.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
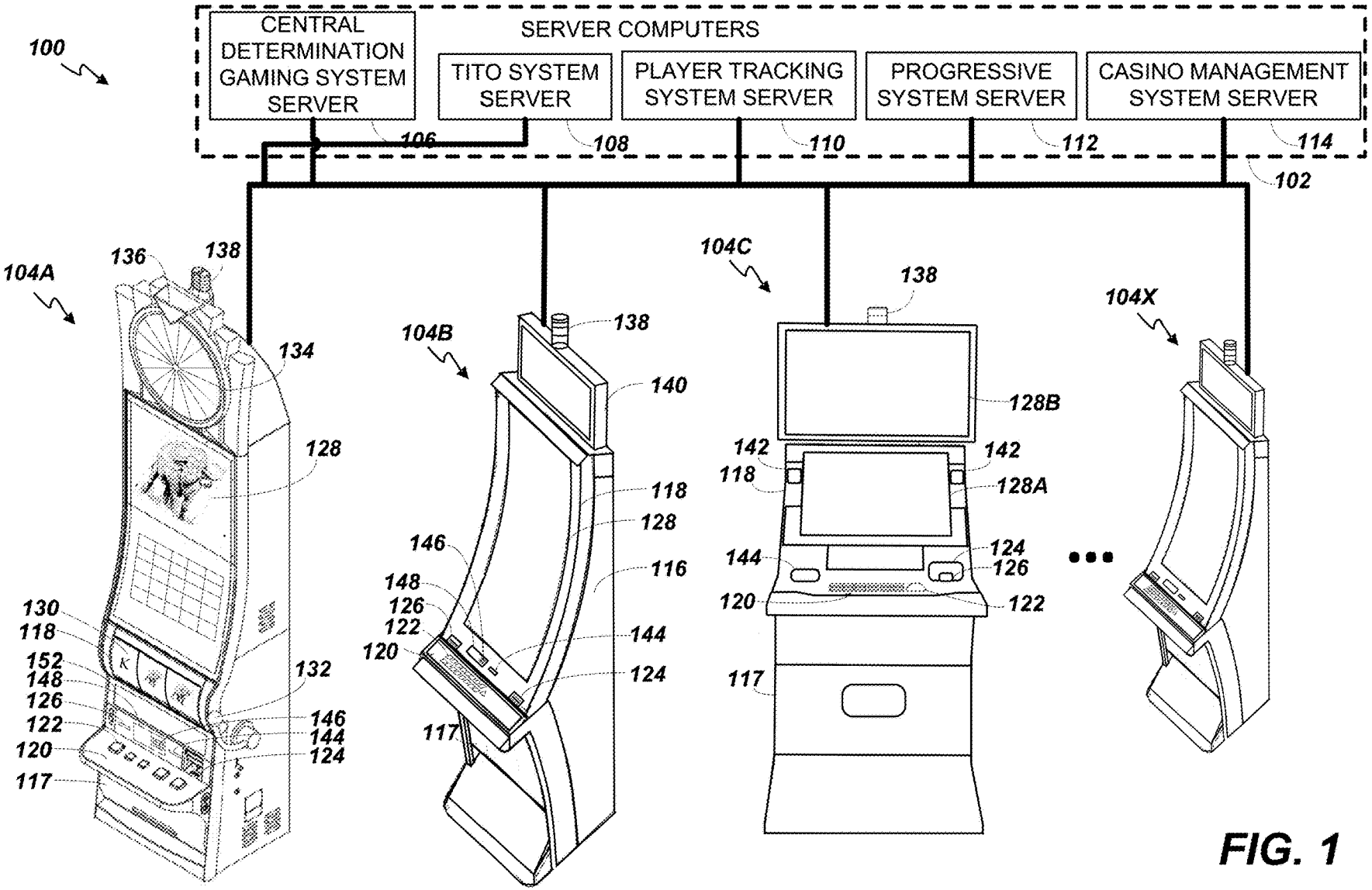
FIG. 1 is an example diagram showing several EGMs networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Some implementations may involve enlarging the playable area of a slot game display when a particular type of symbol lands. This type of symbol may be referred to herein as a "growth symbol" or an "expansion trigger symbol." In some examples, the playable area may be enlarged by adding one or more active display symbol positions to a display symbol column or "reel." Alternatively, or additionally, the playable area may be enlarged by adding one or more active display symbol positions to a display symbol row. According to some implementations, when an expansion trigger symbol lands in a defined area of a slot game display during an instance of a slot game, at least one additional active display symbol position will be presented in a display symbol row or a display symbol column in which the expansion trigger symbol is displayed. The defined area may correspond to some or all of the active display symbol positions, depending on the particular implementation. In some examples, an expansion trigger symbol may be a wild symbol.

In some instances, an award enhancement trigger symbol may be presented in at least one of the active display symbol positions, e.g., in the same display symbol row or display symbol column in which the expansion trigger symbol is or was displayed. One or more enhanced award symbols (such as wild symbols) may be presented in a row or column of active display symbol positions in which the award enhancement trigger symbol is presented. Some examples may involve replacing the expansion trigger symbol with the award enhancement trigger symbol. In some instances, an award enhancement trigger symbol may be a wild symbol.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 also may include a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 127 which may be used to determine an outcome to the game.

In many configurations, the gaming device 104A may have a main display 128 (e.g., video display monitor) mounted to, or above, the gaming display area 127. The main display 128 can be, e.g., a high-resolution LCD, plasma, LED, or OLED panel which may be flat or curved as shown, a cathode ray tube, or other conventional electronically controlled video monitor. The main display 128 may be of one or more various orientations (i.e., landscape or portrait), aspect ratios and resolutions. In some implementations, the main display 128 may include a touchscreen.

In some embodiments, the bill validator 124 may also function as a "ticket-in" reader that allows the player to use a casino-issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems may be used to generate and track unique bar-codes or other indicators printed on tickets to allow players to avoid the use of bills and coins by loading credits using a ticket reader and cashing out credits using a ticket-out printer 126 on the gaming device 104A. The gaming device 104A may have hardware meters for purposes including ensuring regulatory compliance and monitoring the player credit balance. In addition, there can be additional meters that record the total amount of money wagered on the gaming machine, total amount of money deposited, total amount of money withdrawn, and total amount of winnings on gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in the EGM 104A. In such embodiments, a game controller (not shown in FIG. 1) within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
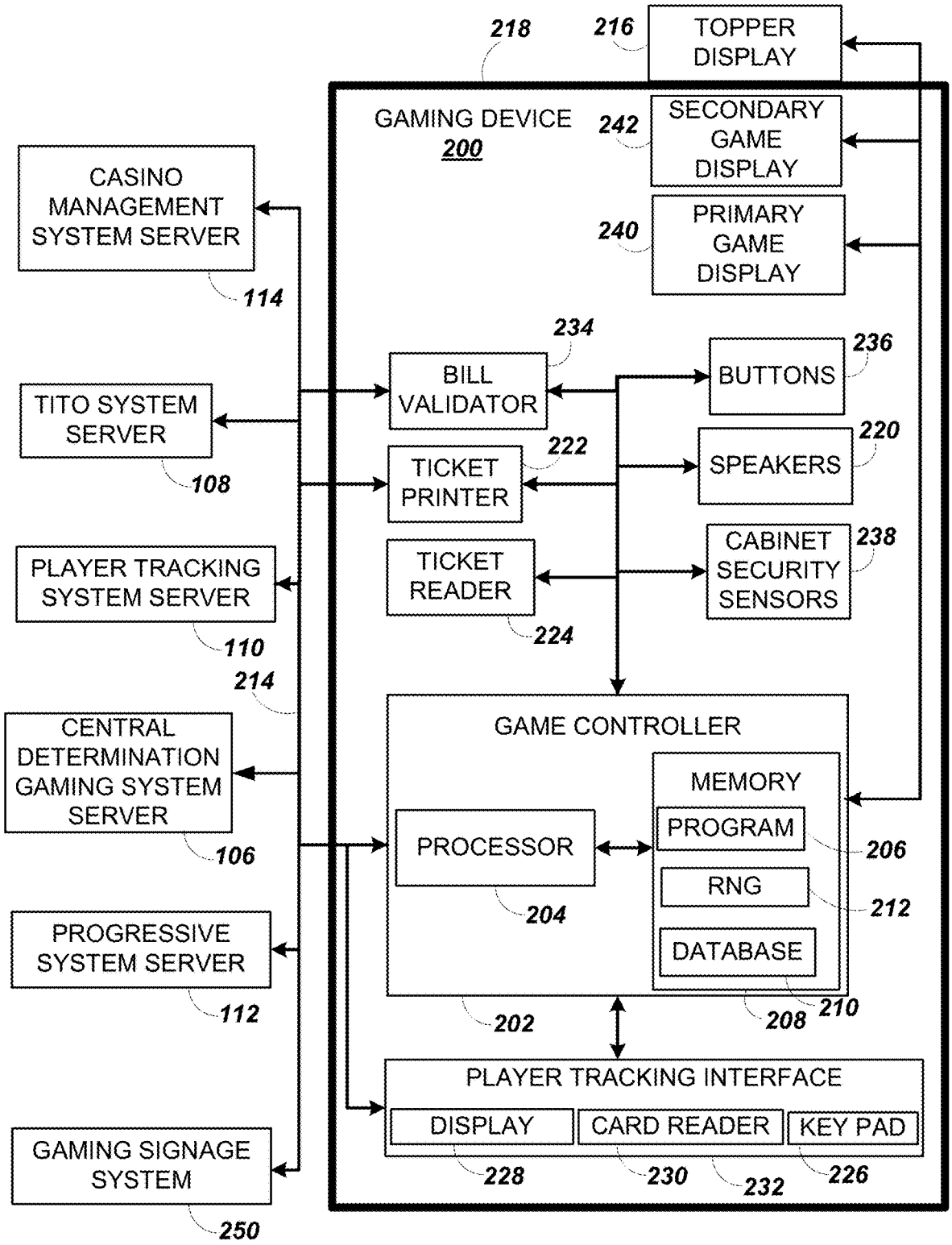
FIG. 2A is a block diagram showing various functional elements of an example EGM.

Many or all of the above-described components can be controlled by circuitry (e.g., a gaming controller) housed inside the main cabinet 116 of the gaming device 104A, the details of which are shown in FIG. 2A.

Note that not all gaming devices that are suitable for implementing embodiments of the present disclosure necessarily include top wheels, top boxes, information panels, cashless ticket systems, and/or player tracking systems. Further, some suitable gaming devices may have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that, where possible, reference numerals identifying similar features of the gaming device 104A embodiment are also identified in the gaming device 104B embodiment using the same reference numbers. Gaming device 104B does not include physical reels, but instead shows game play functions on main display 128. An optional topper screen 140 may be used as a secondary game display for bonus play to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape-style main display 128A may have a curvature radius from top to bottom, or alternatively, from side to side. In some embodiments, main display 128A is a flat panel display. Main display 128A is typically used for primary game play while secondary display 128B is typically used for a bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (a play or round of the game) may be generated on a remote gaming device such as the central determination gaming system server 106 (not shown in FIG. 2A but shown in FIG. 1). The game instance may be communicated to gaming device 200 via the network 214 and then displayed on gaming device 200. Gaming device 200 may execute game software, such as, but not limited to, video streaming software that allows the game to be displayed on gaming device 200. When a game is stored on gaming device 200, it may be loaded from the memory 208 (e.g., from a read only memory (ROM)) or from the central determination gaming system server 106 to memory 208. The memory 208 may include random access memory (RAM), ROM or another form of storage media that stores instructions for execution by the processor 204.

The gaming device 200 may include a topper display 216 or another form of a top box (e.g., a topper wheel, a topper screen, etc.) which sits above main cabinet 218. The cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Some gaming devices, such as gaming devices 104A-104X, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming device 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player can view the game outcome on the primary game display 240 and/or the secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using a player interface system, which may include the player input buttons 236, the primary game display 240 (which may include a touch screen), or some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash-out button to receive a ticket from the ticket printer 222). The ticket may be redeemed for money or inserted into another machine to establish a credit balance for play.

While an example gaming device 200 has been described in regard to FIG. 2A, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having mechanical reels or a video display. Moreover, other embodiments may be designed for bar tables and have displays that face upwards.

Many different types of wagering games, including mechanical slot games, video slot games, video poker, video black jack, video pachinko, keno, bingo, and lottery, may be provided by the gaming device 200. In particular, the gaming device 200 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 200 may allow a player to select a game of chance, skill, or combination thereof, to play from a plurality of instances available on the gaming device 200. For example, the gaming device 200 may provide a menu with a list of the instances of games that are available for play on the gaming device 200 and a player may be able to select, from the list, a game that they wish to play.

Figure 2B:
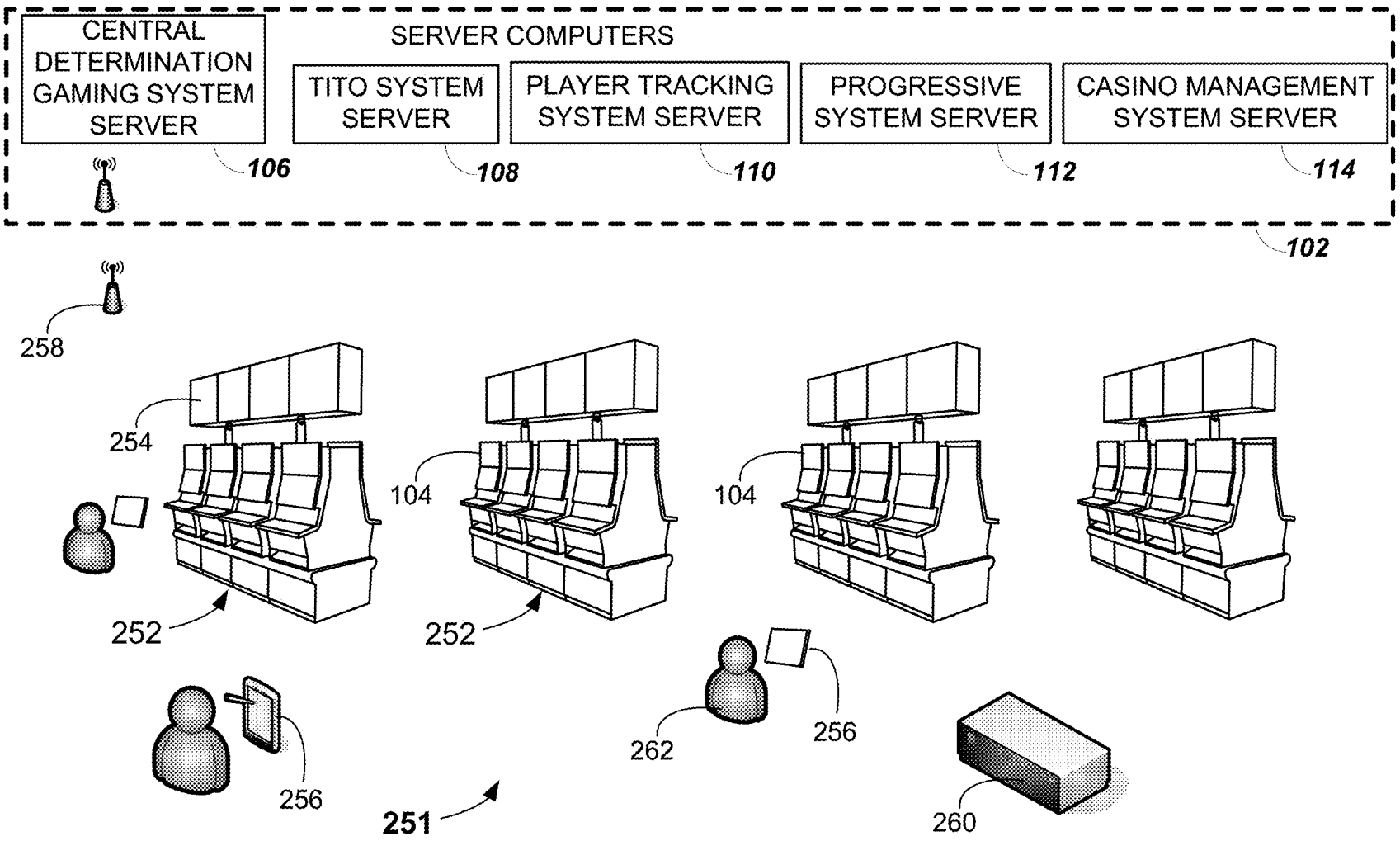
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor (s) to verify the identity of an authorized patron. Some mobile gaming devices 256 may be configured to function only within a predetermined or configurable area, such as a casino gaming area.

Figure 2C:
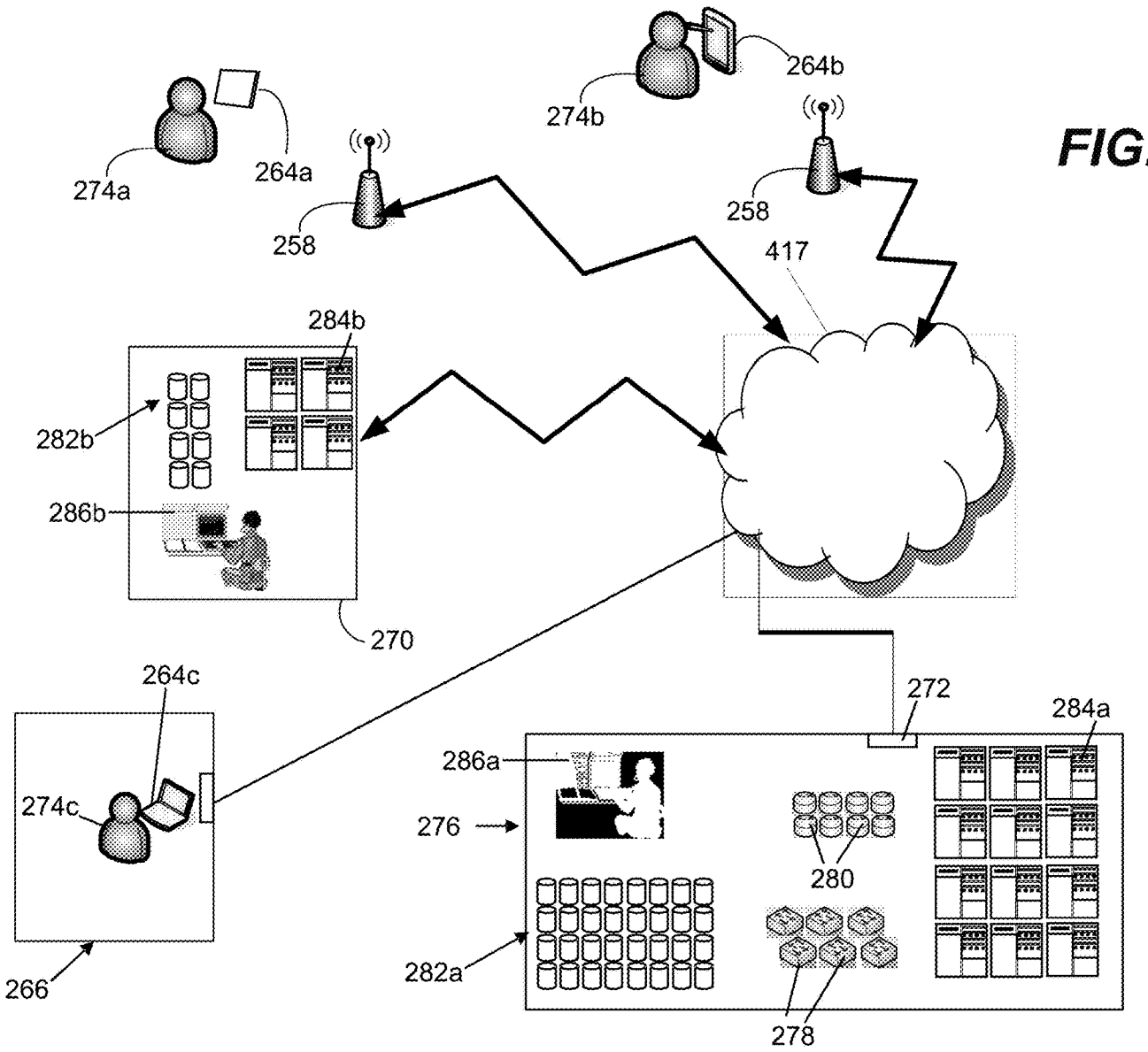
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server (s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3A:
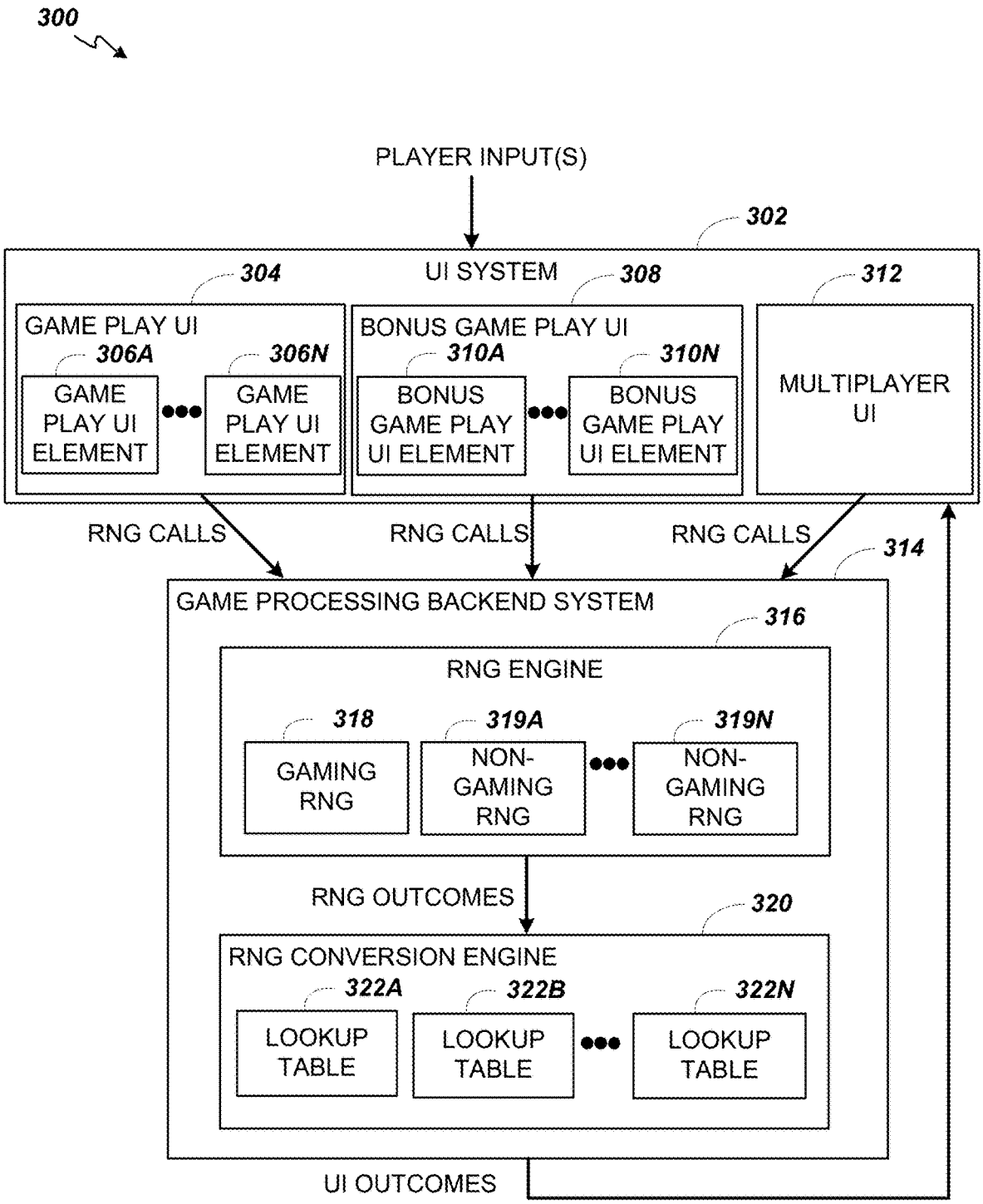
FIG. 3A illustrates, in block diagram form, an example game processing architecture 300 that implements a game processing pipeline for the play of a game in accordance with various embodiments described herein.

FIG. 3A illustrates, in block diagram form, an example game processing architecture 300 that implements a game processing pipeline for the play of a game in accordance with various embodiments described herein. As shown in FIG. 3A, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes, based on the RNG outcomes, for the UI system 302 to use to control game play (e.g., a display to a player). The game processing architecture 300 can implement the game processing pipeline using a gaming device, such as one of the gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, the game play UI 304, bonus game play UI 308, and multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3A as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from the bonus game play UI elements 310A-310N.

FIG. 3A also illustrates that UI system 302 could include a multiplayer UI 312 purposed for game play that differs or is separate from the typical base game. For example, multiplayer UI 312 could be set up to receive player inputs and/or present game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3A does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces ("APIs") to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator ("PRNG") (e.g., Fortuna PRNG) that securely produces random numbers for one or more game features. To generate random numbers, gaming RNG 318 could collect random data from various sources of entropy, such as from an operating system ("OS"). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for purposes such as generating random messages that appear on the gaming device.

The RNG conversion engine 320 processes each RNG outcome from RNG engine 316 and converts the RNG outcome to a UI outcome that is fed back to the UI system 302. As previously described, RNG conversion engine 320 translates the RNG outcome from the RNG 212 to a game outcome presented to a player. For example, RNG conversion engine 320 utilizes one or more lookup tables 322A-322N (weighted tables) to regulate a prize payout amount for each RNG outcome and how often the gaming device pays out the derived prize payout amounts. In one example, the RNG conversion engine 320 could utilize one lookup table to map the RNG outcome to a game outcome displayed to a player and utilize a second lookup table as a pay table for determining the prize payout amount for each game outcome. In this example, the mapping from the RNG outcome to the game outcome can affect the level of volatility for the game, e.g., by regulating the frequency of occurrence of a game feature such as hitting certain prize payout amounts, triggering a bonus game or special mode, winning a progressive jackpot, etc. Different lookup tables could be utilized depending on the different game modes, for example, a base game versus a bonus game. In the context of the innovations described herein, for example, one or more lookup tables can be used to determine upon which active display symbol position an expansion trigger symbol and/or an award enhancement trigger symbol will be displayed, determine a quantity of additional active display symbol positions to display in response to the landing of an expansion trigger symbol and/or a quantity of enhancement symbols to display in response to the landing of an award enhancement trigger symbol, or to determine the type of award enhancement symbols to display.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

In general, the example game processing architecture 300 shown in FIG. 3 can be used to process game play instructions and generate outcomes. For example, in some example implementations, the example game processing architecture 300 implements a game processing pipeline for a process (e.g., mode of a base reel game or bonus reel game) that includes displaying expansion trigger symbols and award enhancement trigger symbols, and presenting additional active symbol display positions and enhanced award symbols. In response to a start condition, the game play UI 304

(or bonus game play UI 308) makes one or more RNG calls to the game processing backend system 314. In response, the backend system 314 performs various operations. Using a gaming RNG 318, the RNG engine 316 generates one or more random numbers, which are passed to the RNG conversion engine 320. The RNG conversion engine 320, using one or more of the random number(s) and one or more of the lookup tables 322A . . . 322N, selects active reels for the process. The active reels include one or more main reels and one or more side reels. In particular, the game processing backend system 314 selects the side reel(s) to use in the process. The RNG conversion engine 320 also, using one or more of the random number(s) and one or more of the lookup tables 322A . . . 322N, selects an active symbol position on an active display symbol row and an active display symbol column on which to display an expansion trigger symbol and, therein, a quantity of additional symbol positions to present on the selected active display symbol row and/or the selected active display symbol column. Using the gaming RNG 318, the RNG engine 316 determines more random numbers, which the RNG conversion engine 320 uses (along with one or more of the lookup tables 322A . . . 322N) to determine one or more selected display symbols to present on the active display symbol positions, which may include one or more award enhancement symbols. The backend system 314 can also determine the outcome of the process (e.g., calculating whether any winning symbol combinations exist on the active symbol positions).

The backend system 314 returns the generated results to the game play UI 304 (or bonus game play UI 308), which displays one or more reel expansion trigger symbols and/or one or more award enhancement trigger symbols on the active display symbol positions, followed with the display of additional active symbol locations and/or the display of award enhancement symbols on the active symbol locations. For example, the backend system 314 can return results of a single RNG call, for which a single RNG is mapped using a lookup table that defines some game-related outcomes, such as presenting one or more expansion trigger symbols on the active display symbol positions and determining the quantity of additional active display symbol positions to provide, and the presenting of one or more award enhancement trigger symbols on the active display symbol positions and the quantity and type of award enhancement symbols to present on the active display symbol positions, as well as additional active display symbol presentation animation effects, and award enhancement symbol presentation animation effects. Alternatively, the game play UI 304 (or bonus game play UI 308) can make one or more separate RNG calls to the backend system 314 to determine additional active display symbol and award enhancement symbol presentation animation effects. In response, the backend system 314 can use the gaming RNG 318 and/or one or more of the non-gaming RNGs 319A . . . 319N to generate random numbers, which the RNG conversion engine 320 uses (with one or more of the lookup tables 322A . . . 322N) to determine additional active display symbol presentation and award enhancement symbol presentation animation effects for the active display symbol expansion and award enhancement symbol presentation operations.

Eventually, the game play UI 304 (or bonus game play UI 308) stops the spinning of the reels at the symbol stop positions returned for the respective reels. Finally, the game play UI 304 (or bonus game play UI 308) outputs an indication of the outcome of the process.

Figure 3B:
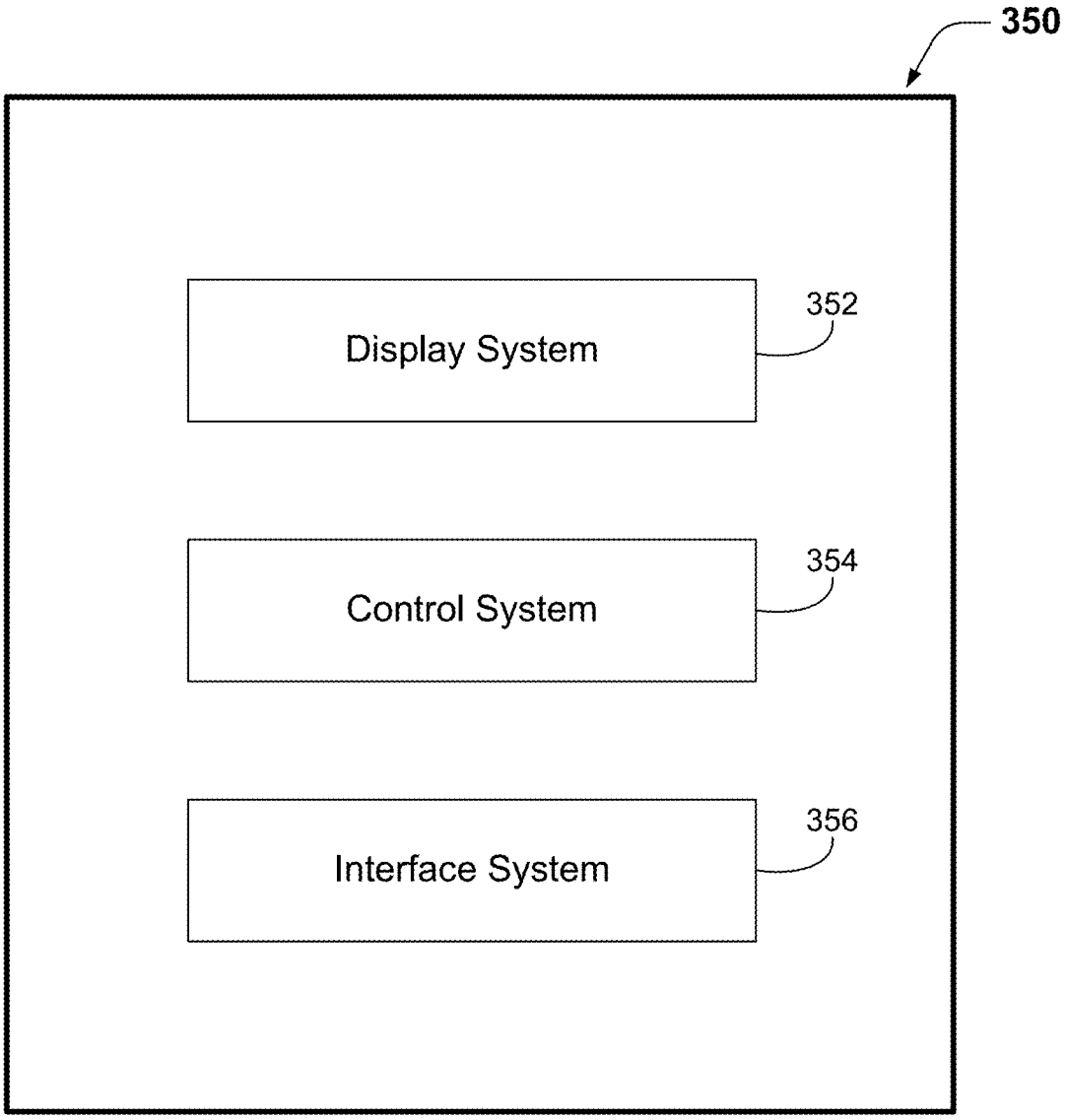
FIG. 3B is a block diagram that shows blocks of an apparatus according to one example.

FIG. 3B is a block diagram that shows blocks of an apparatus according to one example. According to some examples, the apparatus 350 may be, or may include, a gaming device. In some examples, the apparatus 350 may be an EGM such as those described above with reference to FIGS. 1 and 2A. However, in alternative examples, the apparatus 350 may be a mobile device such as described above with reference to FIG. 2B or an EUD as described above with reference to FIG. 2C.

In this example, the apparatus 350 includes a display system 352 and a control system 354 that is configured to communicate with the display system 352. In this example, the control system 354 is configured to communicate with the display system 352 via wired communication, e.g., via electrical signals. In alternative implementations, the control system 354 may be configured to communicate with the display system 352 via wireless communication. Accordingly, at least a portion of the control system 354 may be coupled to the display system 352. As used herein, the term "coupled to" has a meaning that could include being physically coupled for wired communication or being configured for wireless communication.

The control system 354 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 356 is shown as being separate from the control system 354, in some implementations the interface system 356 may be part of the control system 354. In some implementations, the interface system 356 may include the entire control system 354. The control system 354 also may include (and/or be configured for communication with) one or more memory devices, such as one or more random access memory (RAM) devices, read-only memory (ROM) devices and/or other types of non-transitory media. In some implementations, at least a portion of the control system 354 may be implemented as a register. Accordingly, the apparatus 350 may have a memory system that includes one or more memory devices, though the memory system is not shown in FIG. 3B.

The control system 354 may be capable of performing, at least in part, the methods disclosed herein. In some examples, the control system 354 may be capable of performing at least some of the methods described herein according to instructions (e.g., software) stored on one or more non-transitory media. For example, the control system 354 may be configured for controlling the display system 352 and/or for receiving and processing data from at least a portion of the display system 352, e.g., as described below.

The display system 352 may include, one or more liquid crystal displays (LCDs), plasma displays, light-emitting diode (LED) displays, microLED displays or organic light-emitting diode (OLED) displays. According to some implementations, the display system 352 may include at least one flexible display, such as a flexible OLED. Although shown as separate components in FIG. 3B, the display system 352 may, in some examples, include at least a portion of the control system 354. For example, the display system 352 may include one or more processors, microprocessors, programmable logic devices, discrete gates or transistor logic, etc.

In the example shown in FIG. 3B, the apparatus 350 includes an interface system 356. In some examples, the interface system may include a wireless interface system. In some implementations, the interface system 356 may include a network interface, an interface between the control system 354 and the display system 352, an interface between the control system 354 and a memory system and/or an interface between the control system 354 and an external device interface (e.g., a port or an applications processor). In some examples, the interface system 356 may include one or more user interfaces, such as a touch screen, one or more buttons, a gesture recognition system, a voice recognition system, etc.

According to some implementations, the apparatus 350 may be a single device, whereas in other implementations the apparatus 350 may be a system that includes more than one device. Accordingly, the terms "apparatus" and "system" may sometimes be used interchangeably herein. In other examples, the apparatus 350 may be a component of another device. For example, in some implementations at least a portion of the display system 352 and/or the control system 354 may be included in more than one apparatus. For example, in some implementations at least part of the control system 354 may reside in a server, such as a central determination server. Some implementations of the apparatus 350 may not include a display system. In some such implementations, the control system 354 may be configured for controlling the display system of another device.

Figure 4:
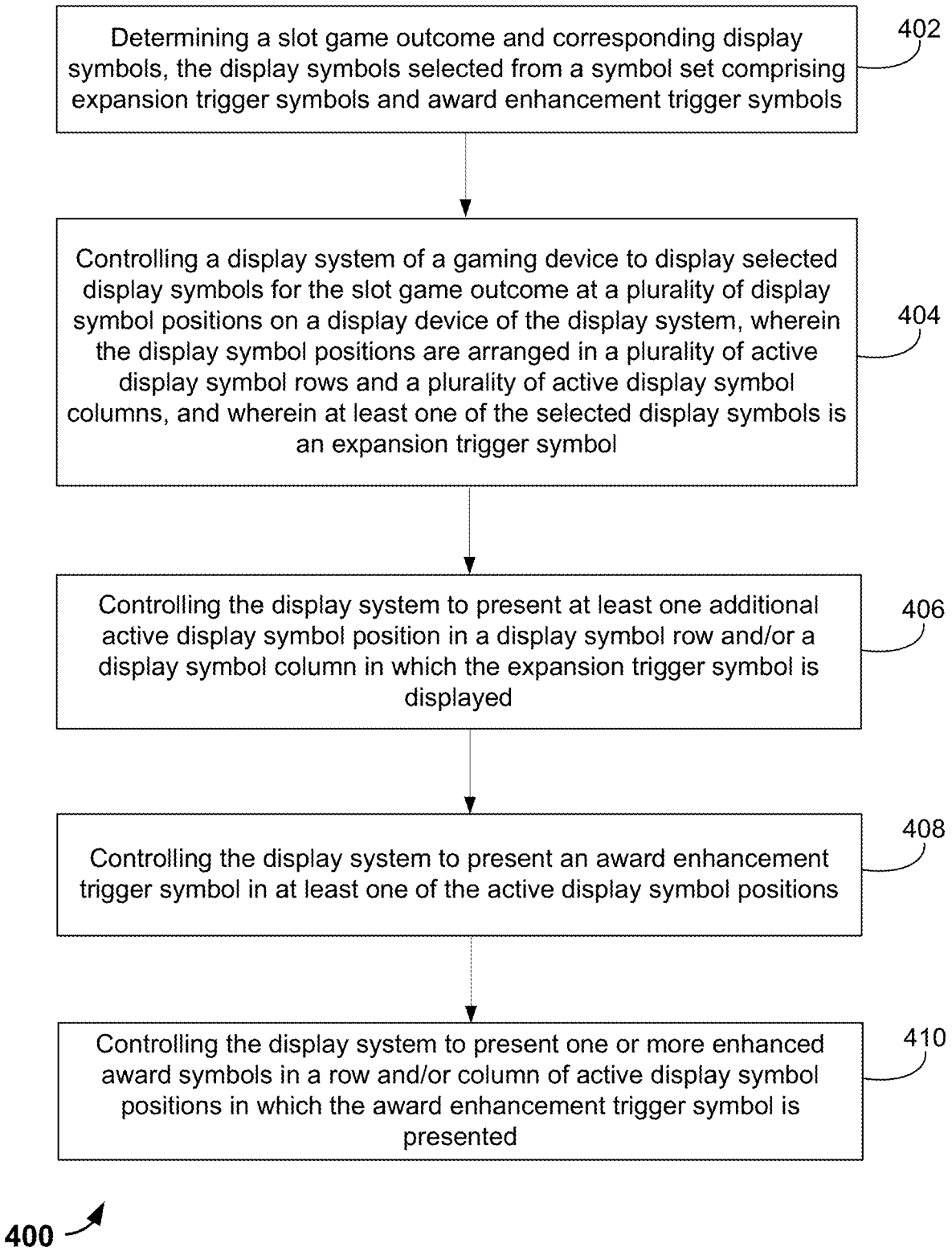
FIG. 4 is a flow diagram that shows blocks of a method according to one example.

FIG. 4 is a flow diagram that shows blocks of a method according to one example. In some examples method 400 may be performed, at least in part, by an apparatus such as that described above with reference to FIG. 3B. In some examples, the method 400 may be performed by a control system (e.g., the control system 354 of FIG. 3B) according to software stored upon one or more non-transitory storage media. As with other methods described herein, the number and sequence of blocks shown in FIG. 4 are merely examples. Similar disclosed methods may include more or fewer blocks. Moreover, at least some of the blocks may occur in a different sequence than the sequence that is shown in a flow diagram.

According to this example, block 402 involves determining a slot game outcome and corresponding display symbols. The determination of block 402 may be made via a control system of a gaming device. According to some such examples, both the UI system 302 and the game processing backend system 314 that are described above with reference to FIG. 3 may reside in a single gaming device.

In some examples, one device (e.g., a server) may determine at least a portion of the slot game outcome (e.g., a particular number of credits to be awarded) and another device (e.g., a local gaming device on which a game is being presented) may determine the display symbols corresponding to the outcome obtained from the server. In some such examples, the UI system 302 may reside in one device and the game processing backend system 314 may reside in another device. According to some alternative examples, one server may implement at least a portion of the UI system 302 and another server may implement the game processing backend system 314.

According to some examples, the display symbols may be selected from a symbol set that includes expansion trigger symbols and award enhancement trigger symbols. The symbol set may, in some instances, include various other types of symbols, such as symbols corresponding to a game theme.

In some examples, block 402 may be performed subsequent to receiving, via a user interface of the gaming device, an indication to initiate a first purchased instance of a base game. In some alternative examples, the game may be a feature or bonus game, e.g., a free game. For example, the user input may be received by the control system 354 of FIG. 3B, via a user interface of the interface system 356. Block 402 may, for example, involve receiving an indication that a user has pressed a "play" button of an EGM, receiving an indication that the user has touched an area of a touch screen that corresponds to a displayed image of a "play" button, etc. In some such implementations, block 402 (or a preceding block of method 400) may involve verifying that there is sufficient credit for at least one instance of a base game.

According to this implementation, block 404 involves controlling a display system of a gaming device to display selected display symbols for the slot game outcome at a plurality of display symbol positions on a display device of the display system. In this example, the display symbol positions are arranged in a plurality of active display symbol rows and a plurality of active display symbol columns. In this instance, at least one of the selected display symbols is an expansion trigger symbol. According to some examples, if an expansion trigger symbol lands in a defined area of a slot game display during an instance of a slot game, at least one additional active display symbol position will subsequently be presented in a display symbol row or a display symbol column. The defined area may correspond to some or all of the active display symbol positions, depending on the particular implementation.

According to this implementation, block 406 involves controlling the display system to present at least one additional active display symbol position in a display symbol row and/or a display symbol column in which the expansion trigger symbol is displayed. In some instances, at least one additional active display symbol position is presented in a display symbol row and at least one additional active display symbol position is presented in a display symbol column in which the expansion trigger symbol is displayed. For example, block 406 may involve causing a row and/or a column to expand by 1, 2 or 3 display symbol positions. In other examples the maximum number of display symbol positions by which a row and/or column may be increased can be greater than three, or less than three. In some instances, the amount of row and/or column expansion may be randomized. However, in some such examples the probability of expanding by the maximum number of display symbol positions may increase at higher bet levels. In some such implementations block 406 (or a subsequent block of method 400) may involve controlling the display system to present a selected display symbol in at least one additional active display symbol position.

In this implementation, block 408 involves controlling the display system to present an award enhancement trigger symbol in at least one of the active display symbol positions. In some instances, an award enhancement symbol may be presented in at least one of the additional active display symbol positions. In some such examples, an award enhancement trigger symbol may be displayed in at least one additional active display symbol position in the display symbol row and an award enhancement trigger symbol may be displayed in at least one additional active display symbol position in the display symbol column. In some examples, the award enhancement trigger symbol may be presented in the display symbol row or the display symbol column in which the expansion trigger symbol is displayed. According to some such examples, presenting the award enhancement trigger symbol involves replacing the expansion trigger symbol with the award enhancement trigger symbol. However, in other instances there may be no relationship between an award enhancement trigger symbol and an expansion trigger symbol. In some implementations, the expansion trigger symbol and/or the award enhancement trigger symbol may be a wild symbol. In some such examples, the wild symbol may be a persistent wild symbol.

According to this implementation, block 410 involves controlling the display system to present one or more enhanced award symbols in a row or column of active display symbol positions in which the award enhancement trigger symbol is presented. In some examples, an enhanced award symbol may be a wild symbol. In other examples, an enhanced award symbol may be an award multiplier symbol. According to some examples, the award multiplier symbol may be a persistent award multiplier symbol. As the term is used herein, a "persistent" display symbol is a display symbol that remains in the same display symbol position during the presentation of at least two consecutive game instances. In some examples, an enhanced award symbol may be a "prize on" or "what you see is what you get" (WYSIWYG) symbol. In some such examples, the prize on symbol may be a credit award prize symbol. According to some examples, the prize on symbol may be a jackpot award symbol. In some implementations, an enhanced award symbol may be a bonus game trigger symbol. According to some implementations, an enhanced award symbol may be a jackpot symbol. According to some instances in which more than one enhanced award symbol is presented in a game outcome, at least one of the enhanced award symbols may be a wild symbol and at least one of the enhanced award symbols may be an award multiplier symbol. In some instances, block 410 may involve moving one or more display symbols in a row and/or column in which the award enhancement trigger symbol is presented, to reveal the one or more enhanced award symbols. In some examples, presenting the one or more enhanced award symbols may involve moving one or more display symbols in the display symbol row and in the display symbol column in which the award enhancement trigger symbol is presented, to reveal the one or more enhanced award symbols. In some such examples, the one or more enhanced award symbols presented in the display symbol row may include at least one award multiplier symbol and the one or more enhanced award symbols presented in the display symbol column may include at least one wild symbol.

Figure 5:
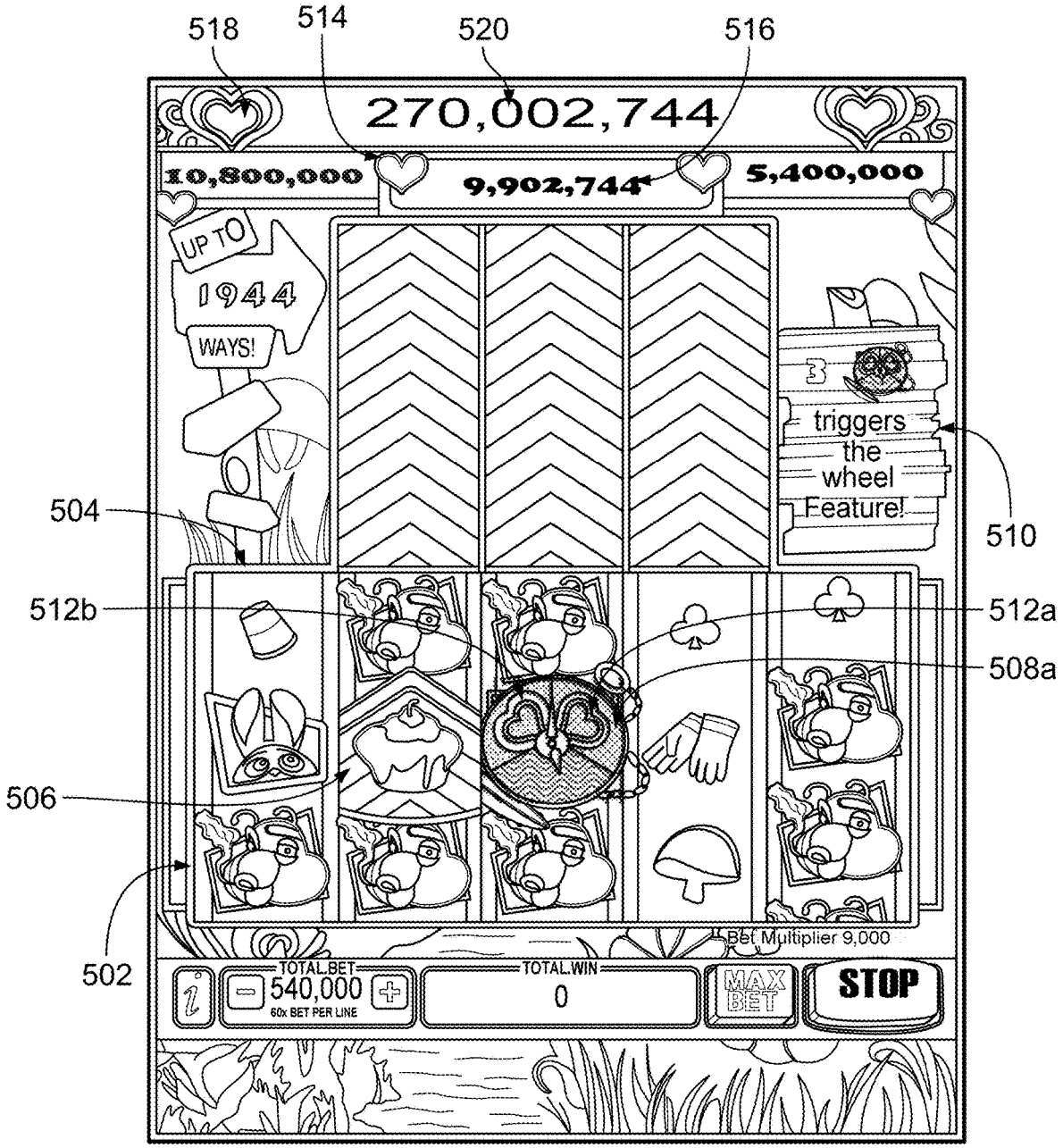
FIG. 5 also shows an example of a feature trigger symbol 508*a*, which is a pocket watch symbol in this example.

FIG. 5 shows an example of a display that may be presented according to one implementation of the method of FIG. 4. As with other implementations provided herein, the particular types of elements and the particular arrangement of elements shown in FIG. 5 are merely examples. In this implementation, the game has an "Alice in Wonderland" theme. In this example, at the moment at which the display of FIG. 5 is being presented, the active display symbol positions include three active display symbol rows 502 and five active display symbol columns 504.

FIG. 5 shows an example of a display that may be presented according to some implementations of block 404 of FIG. 4. In this instance, a display system is being controlled to display selected display symbols for a slot game outcome at a plurality of display symbol positions and at least one of the selected display symbols is an expansion trigger symbol. According to this example, the expansion trigger symbol 506 is a cupcake symbol. In some instances, the expansion trigger symbol 506 may include the words "Eat Me," which correspond to the Alice in Wonderland theme.

FIG. 5 also shows an example of a feature trigger symbol 508*a*, which is a pocket watch symbol in this example. In some implementations, the feature trigger symbol 508*a* may be a "scatter pay" symbol. As shown in banner 510, in this implementation landing at least three feature trigger symbols triggers a feature presentation, which includes a wheel feature in this example. According to this example, the feature trigger symbol 508*a* is an open pocket watch having three internal segments. In this instance, two of the segments include heart images that correspond with the heart images of available jackpots: heart image 512*a* of the feature trigger symbol 508*a* corresponds with heart image 514 and jackpot 516, which may be a progressive jackpot, and whereas heart image 512*b* corresponds with heart image 518 and jackpot 520, which also may be a progressive jackpot. In this implementation, the presence or absence of these heart images indicates whether a sufficiently high wager has been made to "unlock," or make available, the corresponding jackpots. Other states of the feature trigger symbol are described below with reference to FIG. 14.

Figure 6:
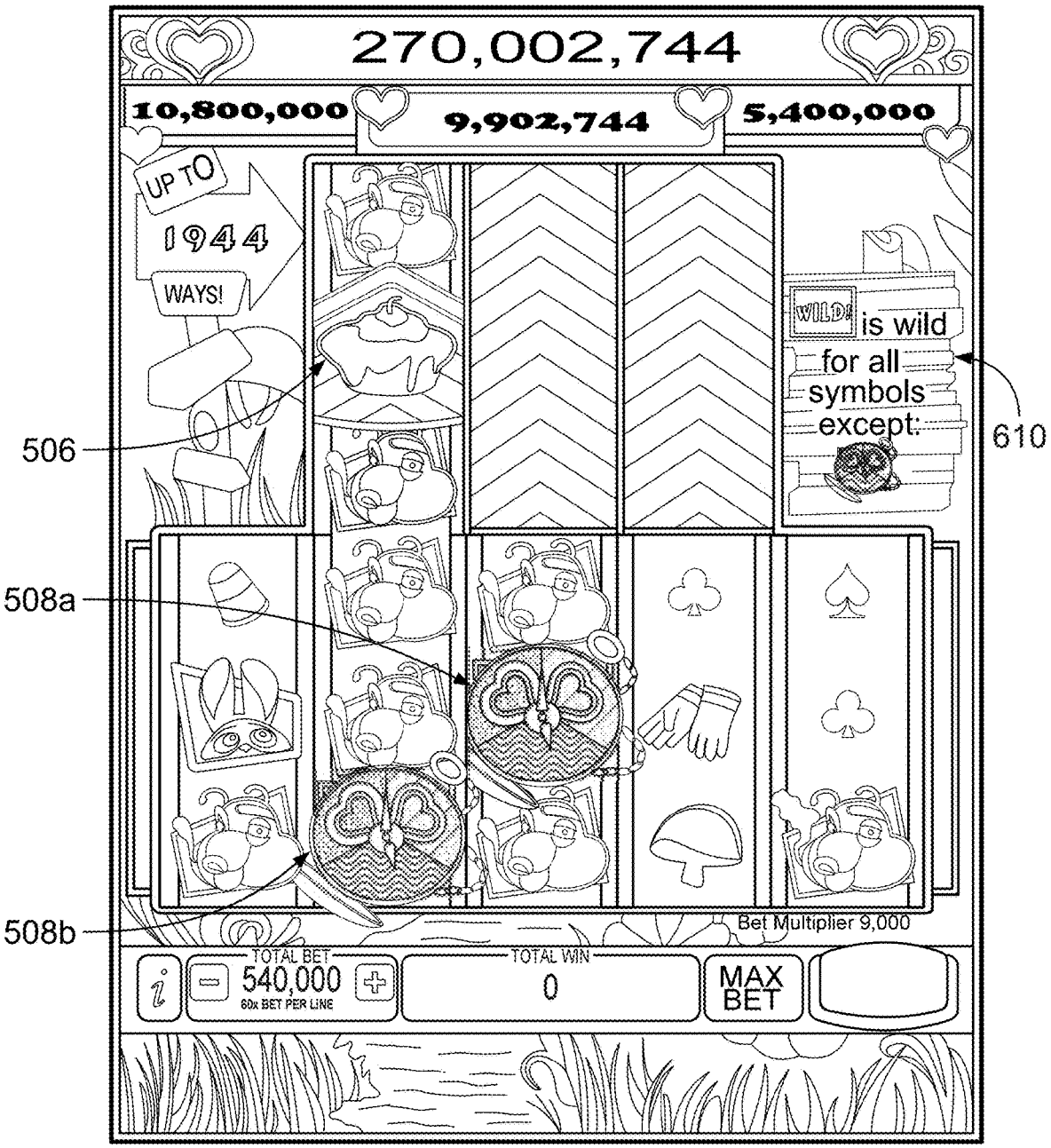
FIG. 6 shows another example of a display that may be presented according to an implementation of the method of FIG. 4.

FIG. 6 shows another example of a display that may be presented according to an implementation of the method of FIG. 4. FIG. 6 shows an example of a display that may be presented after the display of FIG. 5. Accordingly, FIG. 6 shows an example of a display that may be presented according to some implementations of block 406 of FIG. 4.

In this example, a display system has been controlled to present three additional active display symbol positions in a display symbol column in which the expansion trigger symbol 506 is displayed. Accordingly, the reel on which the expansion trigger symbol 506 is displayed now includes three additional selected display symbols, one of which is the feature trigger symbol 508*b*. Having these additional selected display symbols in play, there may be additional ways to win the game.

FIG. 6 provides an indication that a third feature trigger symbol could, in some instances, be presented among the additional selected display symbols that are presented subsequent to the presentation of an expansion trigger symbol. In this example, only two feature trigger symbols are displayed and therefore the feature is not triggered. As noted in banner 610, in this implementation wild symbols do not apply to feature trigger symbols.

Figure 7:
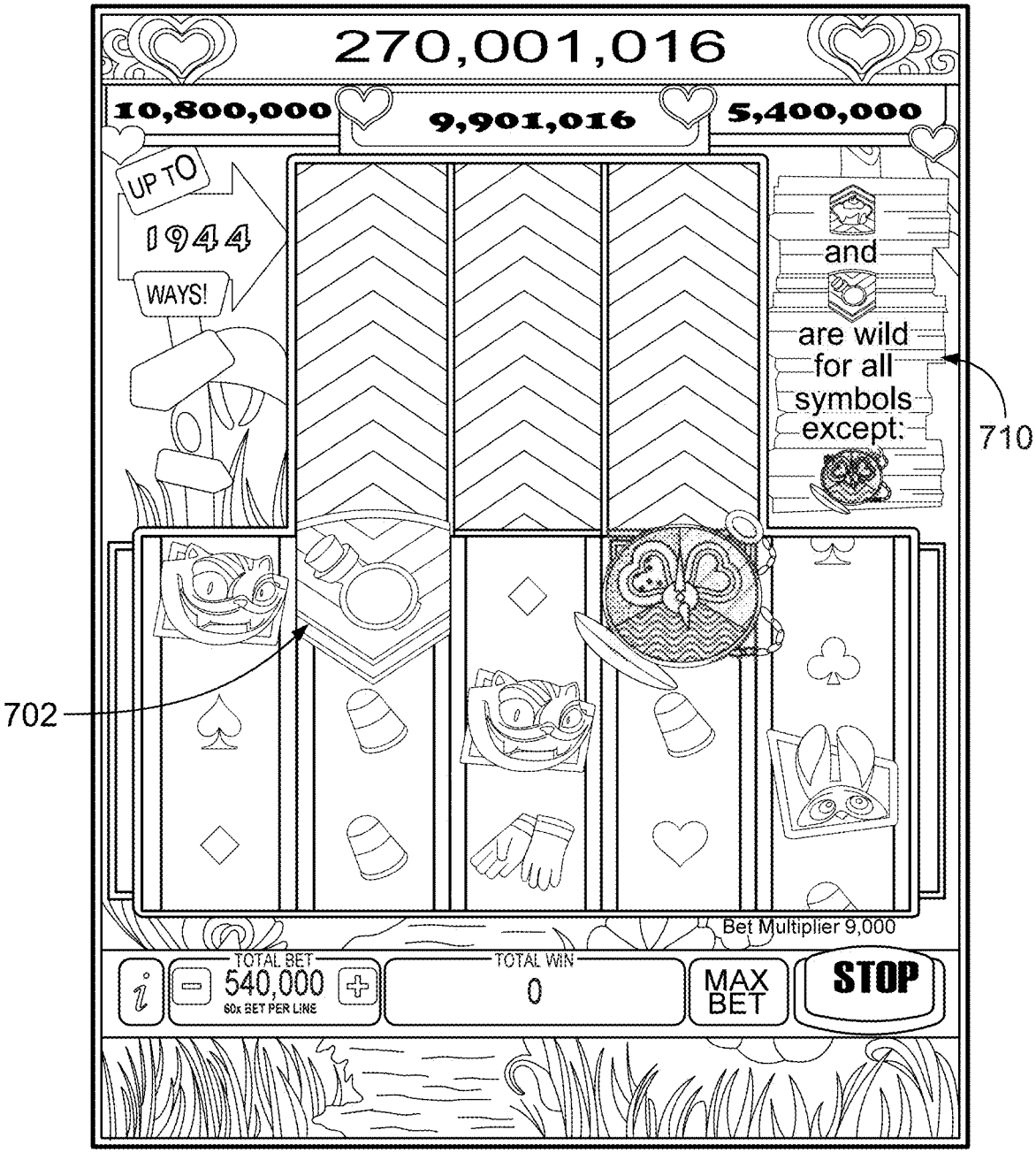
FIG. 7 shows another example of a display that may be presented according to some implementations of the method of FIG. 4.

FIG. 7 shows another example of a display that may be presented according to some implementations of the method of FIG. 4. In this example, the selected display symbols in the display shown in FIG. 7 include an award enhancement trigger symbol 702. Accordingly, FIG. 7 shows an example of a display that may be presented according to some implementations of block 408 of FIG. 4. As noted in banner 710, in this implementation award enhancement trigger symbols and expansion trigger symbols are wild symbols, but these wild symbols do not apply to feature trigger symbols.

Figure 8:
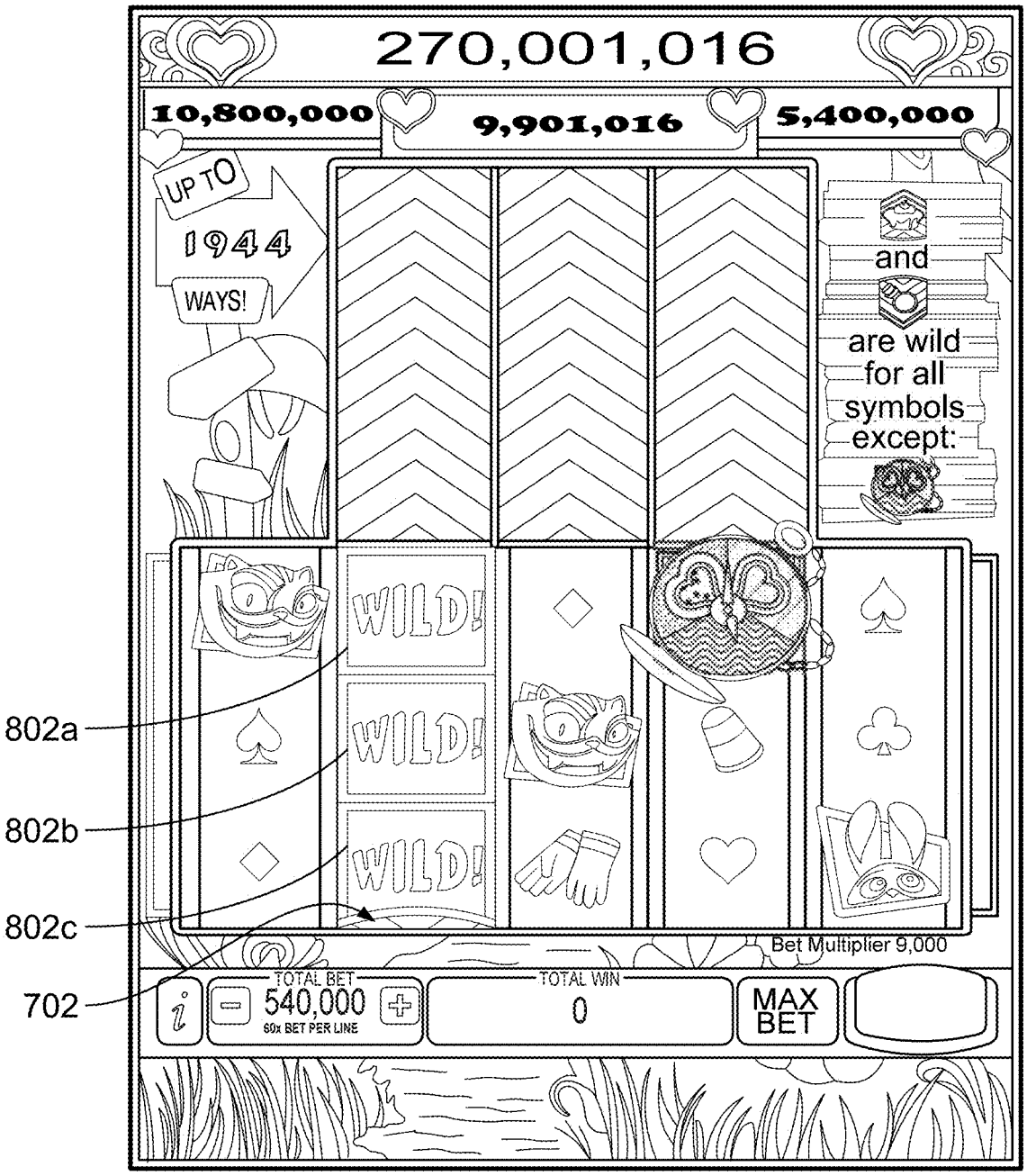
FIG. 8 shows an example of a display that may be presented after the display of FIG. 7.

FIG. 8 shows an example of a display that may be presented after the display of FIG. 7. In this example, the display system has been controlled to present one or more enhanced award symbols in a row or column of active display symbol positions in which the award enhancement trigger symbol 702 is presented. Accordingly, FIG. 8 shows an example of a display that may be presented according to some implementations of block 410 of FIG. 4. In this particular instance, the display system has been controlled to present enhanced award symbols 802*a*, 802*b* and 802*c* in a column of active display symbol positions in which the award enhancement trigger symbol 702 is presented. In this example, the enhanced award symbols 802*a*, 802*b* and 802*c* are wild symbols.

In some implementations, one, two or three enhanced award symbols may be presented in a row or column of active display symbol positions in which the award enhancement trigger symbol 702 is presented. In other examples the maximum number of enhanced award symbols that may be presented can be greater than three, or less than three. According to this example, the award enhancement trigger symbol 702 is shown to roll down three positions, revealing wild symbols that seem to have previously been hidden by overlying symbols that were previously presented on the reel. In some instances, the number of revealed enhanced award symbols may be determined according to a randomized process, e.g., a process that involves determining a random or quasi-random number. In some such examples the probability of revealing the maximum number of enhanced award symbols may increase at higher bet levels.

In some instances, an award enhancement trigger symbol and an expansion trigger symbol may be selected and displayed during the same instance of a game. According to some examples, after an expansion symbol lands and the expansion has been presented, a player may be awarded according to the display symbols that are presented at that moment. In some such examples, if an enhancement trigger symbol is also part of the game outcome, when the enhancements symbols are presented (or soon after the enhancements symbols are presented), the player may be awarded again. In other words, a control system may cause the player to be awarded twice during a single game instance. One award may be based on the expansion outcome and the second award may be based on the enhancement outcome.

Figure 9:
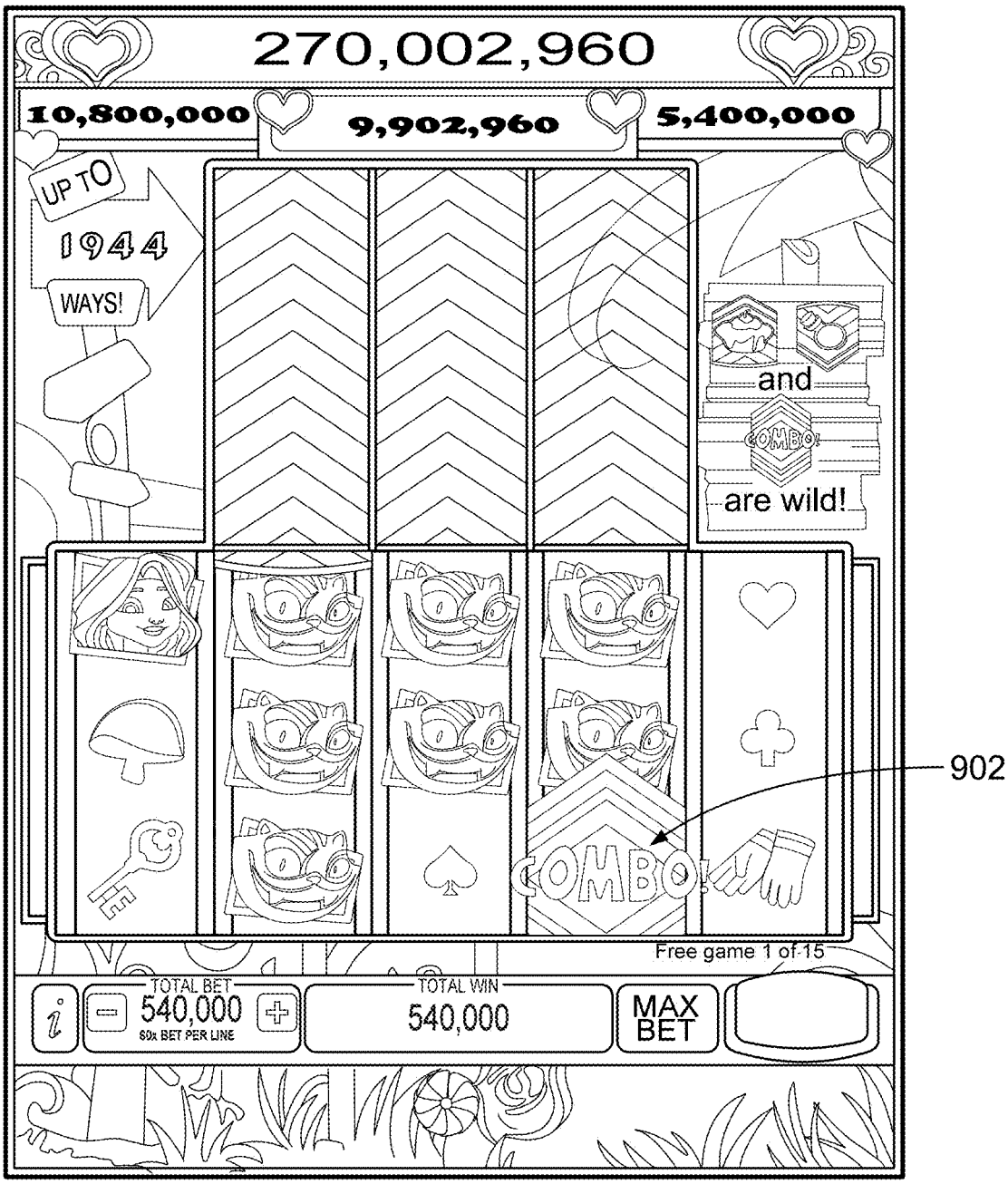
FIG. 9 shows another example of a display that may be presented according to some implementations of the method of FIG. 4.

FIG. 9 shows another example of a display that may be presented according to one implementation of the method of FIG. 4. In this example, the display includes a presentation of combinational (combo) symbol 902. According to some examples, the combo symbol 902 may function as both an expansion trigger symbol and an award enhancement trigger symbol. According to some such examples, the combo symbol 902 may first function as an expansion trigger symbol and then as an award enhancement trigger symbol. Accordingly, FIG. 9 shows an alternative example of a display that may be presented according to some implementations of block 404 of FIG. 4.

Figure 10:
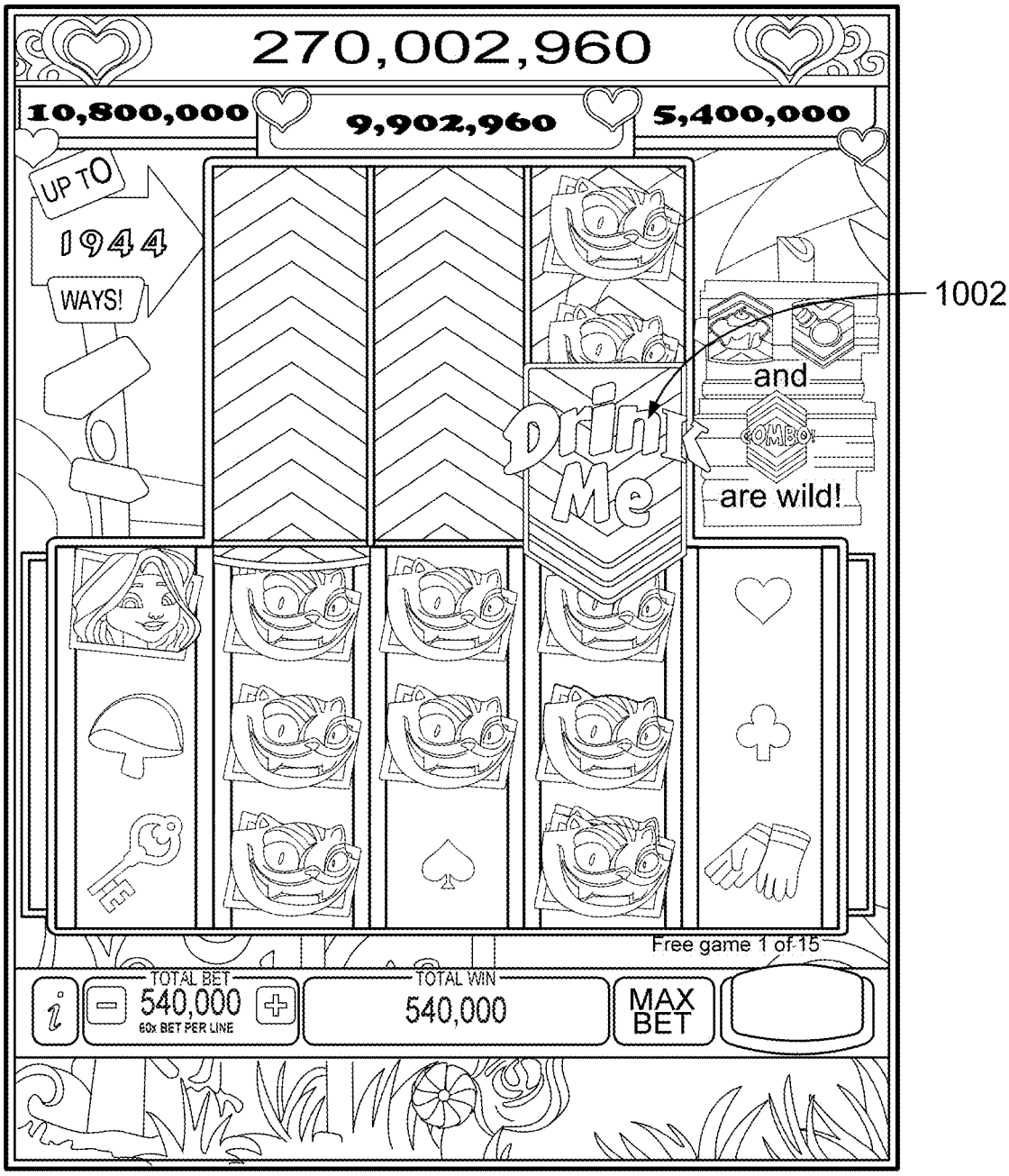
FIG. 10 shows an example of a display that may be presented after the display of FIG. 9.

FIG. 10 shows an example of a display that may be presented after the display of FIG. 9. At the time depicted by the display in FIG. 10, the combo symbol 902 shown in FIG. 9 has already functioned as an expansion trigger symbol. In some such examples, the combo symbol 902 may have morphed into, or been replaced by, an expansion trigger symbol (such as a symbol that says "Eat Me"). Accordingly, a control system has caused the display system to present three additional active display symbol positions in a display symbol column in which the combo symbol 902 shown in FIG. 9 was displayed.

In FIG. 10, the award enhancement trigger symbol 1002 is being presented. Accordingly, FIG. 10 shows an alternative example of a display that may be presented according to some implementations of block 408 of FIG. 4. In this example, presenting the award enhancement trigger symbol 1002 comprises replacing the previously-displayed expansion trigger symbol with the award enhancement trigger symbol 1002.

Figure 11:
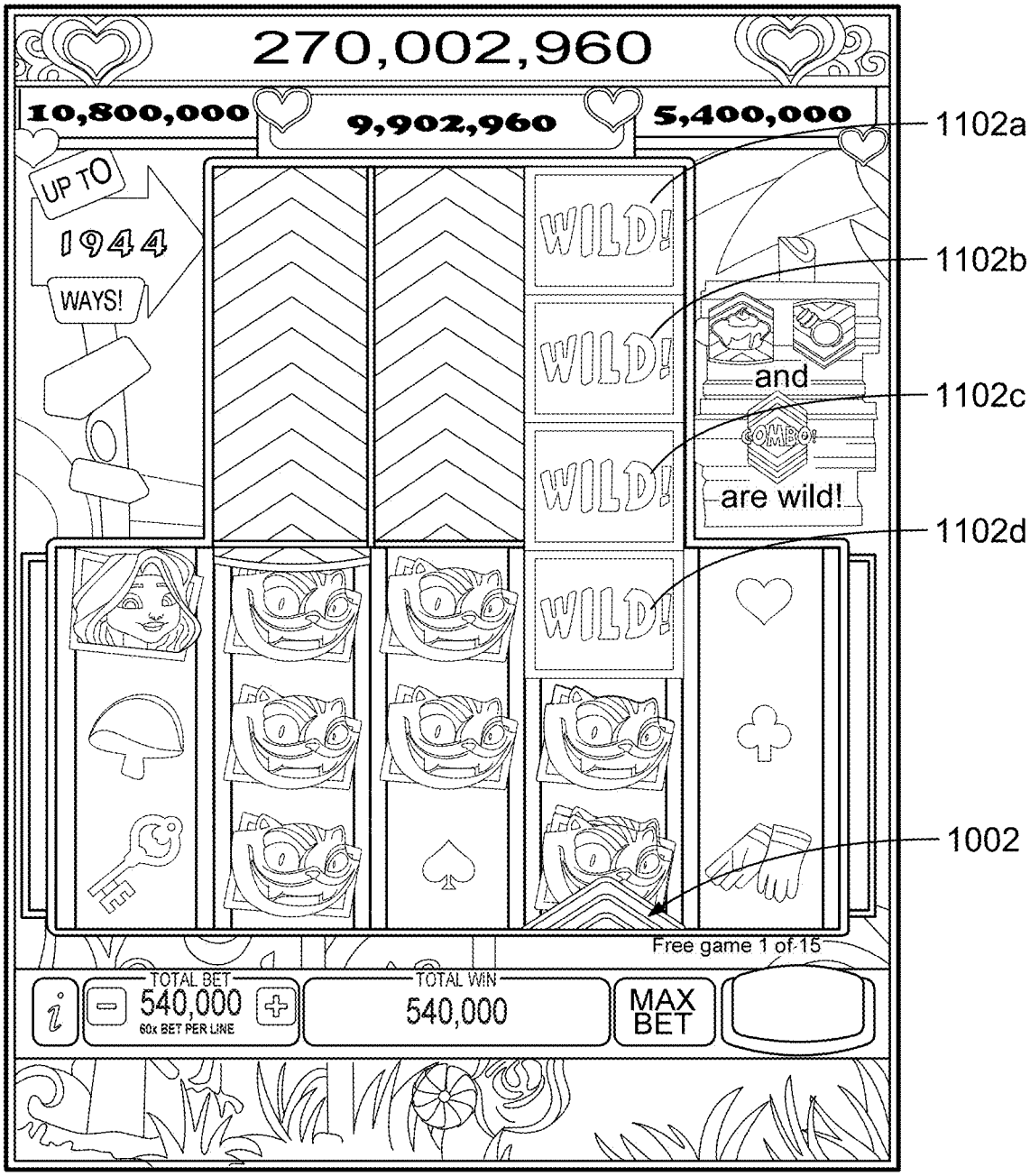
FIG. 11 shows an example of a display that may be presented after the display of FIG. 10.

FIG. 11 shows an example of a display that may be presented after the display of FIG. 10. FIG. 11 shows an example of presenting one or more enhanced award symbols in a column of active display symbol positions in which the award enhancement trigger symbol 1002 is presented. Accordingly, FIG. 11 shows an alternative example of a display that may be presented according to some implementations of block 410 of FIG. 4. According to this example, the award enhancement trigger symbol 1002 is shown to roll down four positions, revealing wild symbols 1102*a*-1102*d* that seem to have been previously been hidden by overlying symbols that were previously presented on the reel.

Figure 12:
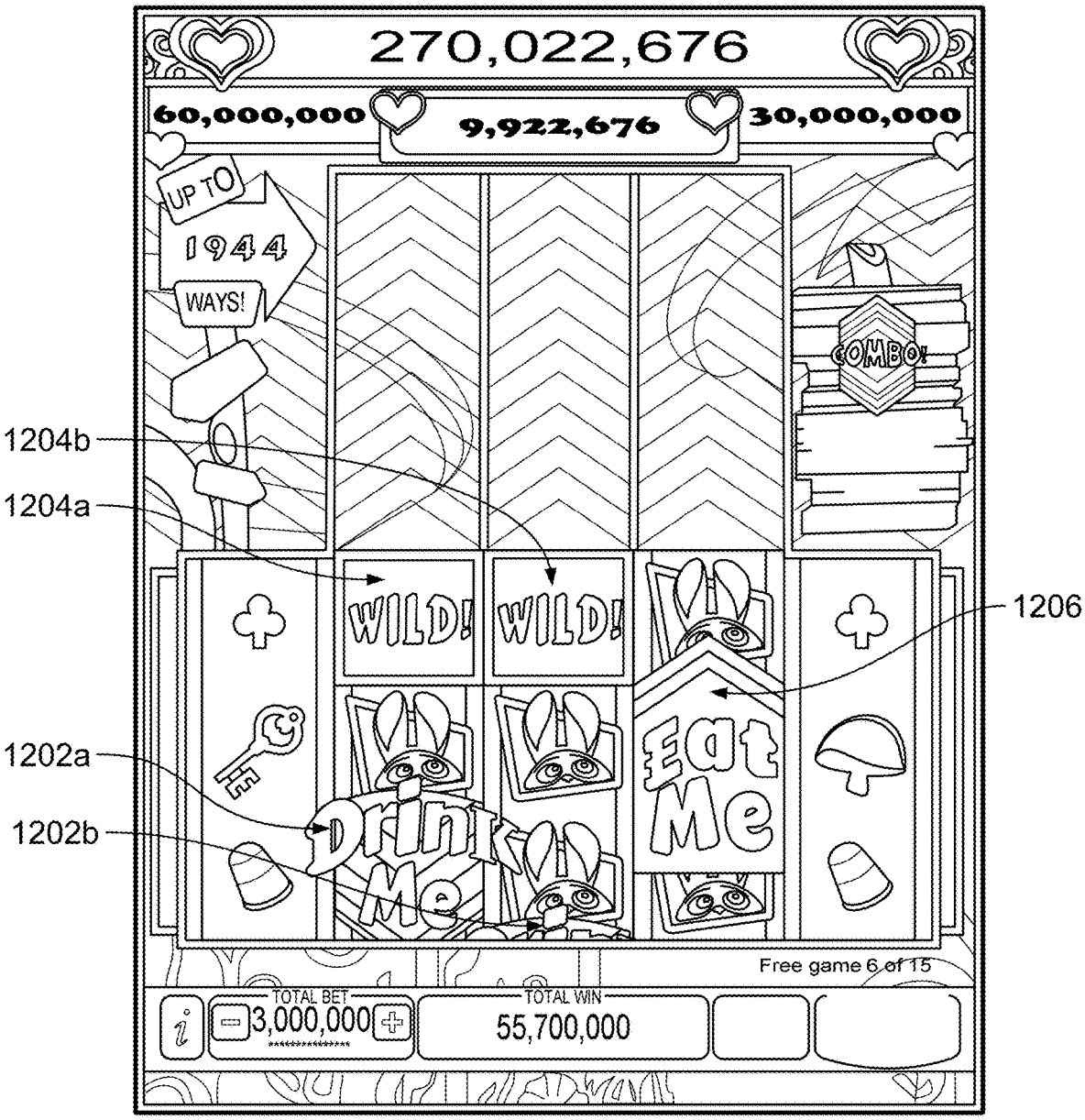
FIG. 12 shows another example of a display that may be presented according to some implementations.

FIG. 12 shows another example of a display that may be presented according to some implementations. FIG. 12 shows an example of different types of trigger symbols being displayed at the same time. In this example, an expansion trigger symbol 1206 and two award enhancement trigger symbols (award enhancement trigger symbols 1202*a* and 1202*b*) are being simultaneously displayed, one in each of three different display symbol columns.

In this example, the award enhancement trigger symbols 1202*a* and 1202*b* have been shifted downwards to reveal wild symbols 1204*a* and 1204*b* that were, or seemed to have been, previously hidden by overlying symbols that were previously presented on the reel. Accordingly, FIG. 12 shows an example of a display that may be presented according to some implementations of blocks 404, 408 and 410 of FIG. 4.

In some implementations, award enhancement trigger symbols 1202*a* and 1202*b* may have previously been displayed with a different appearance, e.g., like that of award enhancement trigger symbol 702 of FIG. 7. Similarly, in some instances the expansion trigger symbol 1206 may have previously been displayed with a different appearance, e.g., like that of the combo symbol 902 of FIG. 9.

Figure 13:
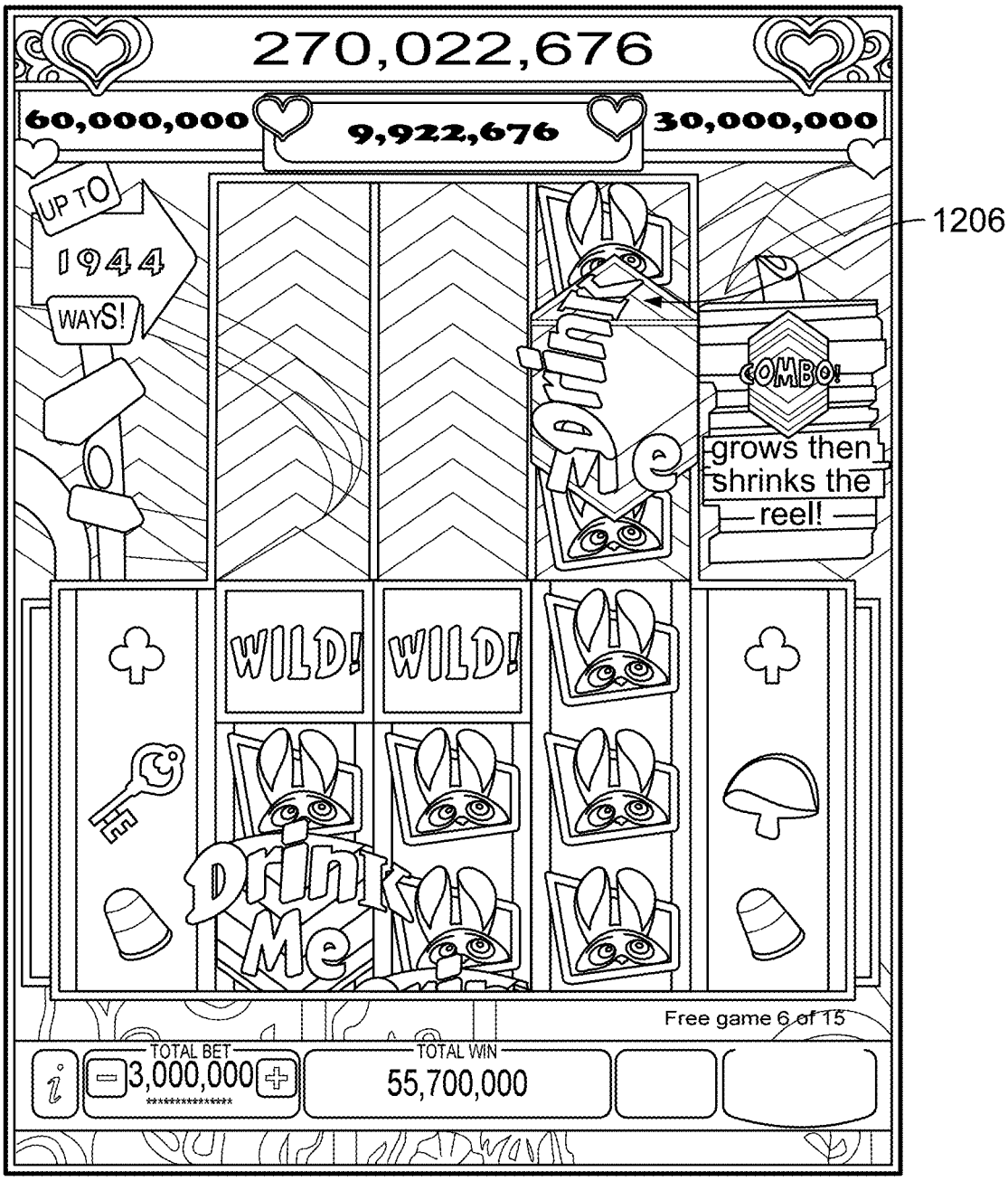
FIG. 13 shows an example of a display that may be presented subsequent to the display shown in FIG. 12.

FIG. 13 shows an example of a display that may be presented subsequent to the display shown in FIG. 12. In this example, three additional active display symbol positions have been displayed in a display symbol column in which the expansion trigger symbol 1206 is displayed. Accordingly, FIG. 13 shows an example of what may be displayed in block 406 of FIG. 4. At the moment depicted in FIG. 13, the expansion trigger symbol 1206 is shown to be transforming from an expansion trigger symbol to an award enhancement trigger symbol. Subsequently, the display system may be controlled to present one or more enhanced award symbols in the column of active display symbol positions in which the award enhancement trigger symbol is presented.

FIGS. 12 and 13 provide an example of an instance in which an award enhancement trigger symbol and an expansion trigger symbol are selected and displayed during the same instance of a game. According to some examples, after an expansion symbol (or a combo symbol) lands and the expansion has been presented, a player may be awarded according to the display symbols that are presented at that moment. In some such examples, if an enhancement trigger symbol is also part of the game outcome, when the enhancements symbols are presented (or soon after the enhancements symbols are presented), the player may be awarded again. In other words, a control system may cause the player to be awarded twice during a single game instance. One award may be based on the expansion outcome and the second award may be based on the enhancement outcome.

In alternative examples, at least one enhancement outcome may be presented first, e.g., as shown in FIGS. 12 and 13. In some such examples, one award may be based on the enhancement outcome(s) presented first and the second award may be based on the expansion outcome. According to some alternative examples, at least one enhancement outcome may be presented before a combo symbol. In some such examples, one award may be based on the enhancement outcome(s) presented first, a second award may be based on the expansion presentation of the combo symbol and a third award may be based on the enhancement outcome of the combo symbol.

Figure 14:
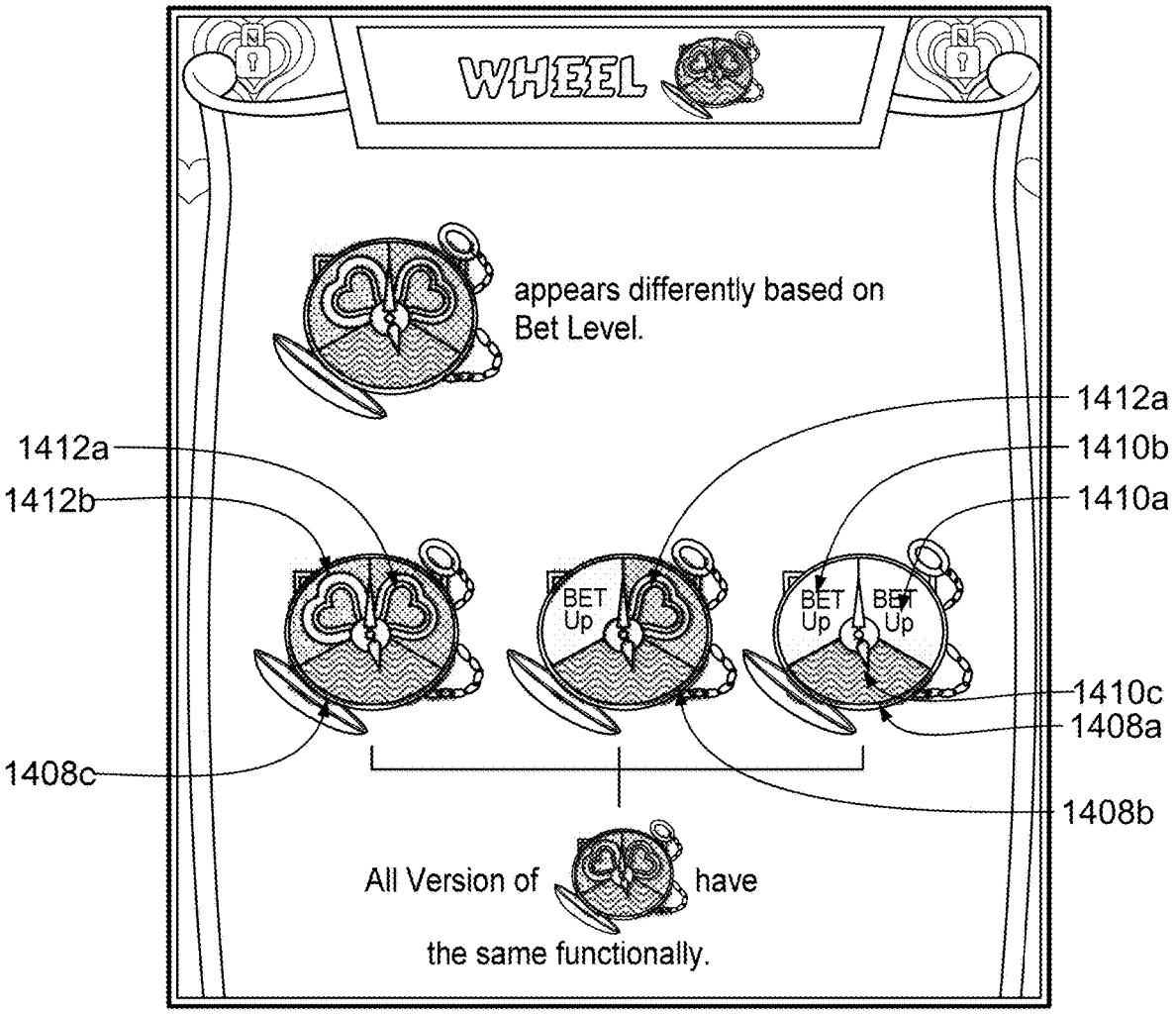
FIG. 14 shows three examples of a feature trigger symbol that may be presented during an instance of a slot game.

FIG. 14 shows three examples of a feature trigger symbol that may be presented during an instance of a slot game. FIG. 14 may, for example, be displayed in response to user input received on a gaming device. The user input may have been for additional information about the feature trigger symbol.

In this example, the feature trigger symbols are pocket watch symbols like those that are described above with reference to FIG. 5. According to this example, the feature trigger symbols 1408*a*, 1408*b* and 1408*c* are depicted as open pocket watches having internal segments 1410*a*, 1410*b* and 1410*c*.

In this implementation, the presence or absence of heart images in one or more of the internal segments 1410*a* and 1410*b* indicates whether a sufficiently high wager has been made to "unlock," or make available, one or two jackpots. In this example, the feature trigger symbol 1408*a* corresponds to an instance in which the current wager is too low to unlock either of the two jackpots. Whenever the feature trigger symbol 1408*a* is displayed, a player receives not only a reminder that the player has not made a sufficiently high wager to unlock these jackpots, but also an exhortation to "Bet Up" and unlock the jackpots.

In this example, the feature trigger symbol 1408*b* includes a heart image 1412*a* in the internal segment 1410*a*. According to this example, the feature trigger symbol 1408*b* corresponds to an instance in which the current wager is high enough to unlock a jackpot that corresponds with the heart image 1412*a*, but too low to unlock another jackpot. Whenever the feature trigger symbol 1408*b* is displayed, the player will be reminded that the player has not made a sufficiently high wager to unlock the second jackpot, along with an exhortation to "Bet Up" and unlock the second jackpot.

According to this example, the feature trigger symbol 1408*c* includes a heart image 1412*a* in the internal segment 1410*a* and a heart image 1412*b* in the internal segment 1410*b*. In this example, the feature trigger symbol 1408*c* corresponds to an instance in which the current wager is high enough to unlock jackpots that correspond with the heart image 1412*a* and the heart image 1412*b*.

In this example, the feature trigger symbols 1408*a*-1408*c* all have the same functionality. However, in alternative implementations the feature trigger symbols 1408*a*-1408*c* may have at least somewhat different functionality. For example, in some alternative implementations the feature trigger symbol 1408*b* and/or 1408*c* may be a wild symbol.

While specific examples have been described with respect to the figures, it will be appreciated that many modifications and changes may be made by those skilled in the art without departing from the scope of the present disclosure. For example, although some examples are described as embodiments of base games, the concepts disclosed herein can also be applied to other types of games, such as feature games or bonus games, e.g., free spins of a slot game. Similarly, although some examples are described as embodiments of feature games or bonus games, e.g., free spins of a slot game, the concepts disclosed herein can also be applied to other types of games, such as base games. Any variation and derivation from the above description and figures are included in the scope of the present disclosure as defined by the claims.

The invention claimed is:

1. A gaming device, comprising:

a user interface system configured for receiving an indication to initiate one or more instances of a slot game;

a display system comprising one or more display devices; and a control system comprising one or more processors, the control system configured for controlling the gaming device to present the one or more instances of the slot game, wherein presenting the one or more instances of the slot game comprises:

receiving an indication, via the user interface system, of a player's initiation of one or more instances of the slot game;

determining a slot game outcome and corresponding display symbols, the display symbols selected from a symbol set comprising expansion trigger symbols, award enhancement trigger symbols, and combination trigger symbols that function as both an expansion trigger symbol and an award enhancement trigger symbol;

controlling, in response to receiving the indication via the user interface system, the display system to display selected display symbols for the slot game outcome at a plurality of display symbol positions on a display device of the display system, wherein the display symbol positions are arranged in a plurality of active display symbol rows and a plurality of active display symbol columns, and wherein at least one of the selected display symbols is a combination trigger symbol;

controlling, in response to displaying the combination trigger symbol, the display system to change the displayed combination trigger symbol to the expansion trigger symbol and thereby present the expansion trigger symbol;

controlling the display system to present at least one additional active display symbol position in a display symbol row or a display symbol column in which the expansion trigger symbol is displayed;

controlling, after presenting the at least one additional active display symbol position and in response to displaying the expansion trigger symbol, the display system to change the displayed expansion trigger symbol to the award enhancement trigger symbol and thereby present the award enhancement trigger symbol in at least one of the active display symbol positions; and controlling the display system to present one or more enhanced award symbols in a row or column of active display symbol positions in which the expansion trigger symbol was presented.

2. The gaming device of claim 1, wherein the one or more enhanced award symbols comprise one or more wild symbols, one or more award multiplier symbols, and/or one or more bonus game trigger symbols.

3. The gaming device of claim 2, wherein the one or more wilds symbols are persistent wild symbols and/or the one or more award multiplier symbols are persistent multiplier symbols.

4. The gaming device of claim 1, wherein the controlling the display system to change the displayed expansion trigger symbol to the award enhancement trigger symbol is further in response to displaying the combination trigger symbol.

5. The gaming device of claim 1, wherein presenting the one or more instances of the slot game further comprises controlling the display system to present visual effects of both (i) the displayed award enhancement trigger symbol and (ii) one or more enhanced award symbols, simultaneously moving in the same direction downwards or upwards in the display symbol column in which the expansion trigger symbol was presented.

6. The gaming device of claim 1, wherein the one or more enhanced award symbols comprise one or more prize on symbols.

7. The gaming device of claim 6, wherein the one or more prize on symbols comprise one or more credit award prize symbols or one or more jackpot award symbols.

8. The gaming device of claim 1, wherein the expansion trigger symbol is a wild symbol.

9. The gaming device of claim 1, wherein the expansion trigger symbol is an award multiplier symbol.

10. The gaming device of claim 1, wherein the expansion trigger symbol is a prize on symbol.

11. A method of controlling an electronic gaming device, the method comprising:

determining a slot game outcome and corresponding display symbols that will be presented on a display system of the electronic gaming device for an instance of a slot game, the display symbols selected from a symbol set comprising expansion trigger symbols, award enhancement trigger symbols, and combination trigger symbols that function as both an expansion trigger symbol and an award enhancement trigger symbol;

controlling, via a control system of the electronic gaming machine that includes one or more processors, the display system to display selected display symbols for the slot game outcome at a plurality of display symbol positions on a display device of the display system, wherein the display symbol positions are arranged in a plurality of active display symbol rows and a plurality of active display symbol columns, and wherein at least one of the selected display symbols is a combination trigger symbol;

controlling, via the control system and in response to displaying the combination trigger symbol, the display system to change the displayed combination trigger symbol to the expansion trigger symbol and thereby present the expansion trigger symbol;

controlling, via the control system, the display system to present at least one additional active display symbol position in a display symbol row or a display symbol column in which the expansion trigger symbol is displayed;

controlling, via the control system and after presenting the at least one additional active display symbol position and in response to displaying the expansion trigger symbol, the display system to change the displayed expansion trigger symbol to the award enhancement trigger symbol and thereby present the award enhancement trigger symbol in at least one of the active display symbol positions; and controlling, via the control system, the display system to present one or more enhanced award symbols in a row or column of active display symbol positions in which the expansion trigger symbol was presented, wherein: the controlling the display system to present one or more of: the combination trigger symbol, the expansion trigger symbol, and the award enhancement trigger symbol is based, at least in part, on one or more of a random number determination, a quasi-random number determination, or a bet amount of a user for one instance of the slot game.

12. The method of claim 11, wherein the one or more enhanced award symbols comprise one or more wild symbols, one or more award multiplier symbols, and/or one or more bonus game trigger symbols.

13. The method of claim 12, wherein the one or more wilds symbols are persistent wild symbols and/or the one or more award multiplier symbols are persistent multiplier symbols.

14. The method of claim 11, wherein the controlling the display system to change the displayed expansion trigger symbol to the award enhancement trigger symbol is further in response to displaying the combination trigger symbol.

15. The method of claim 11, wherein presenting the one or more instances of the slot game further comprises controlling the display system to present visual effects of both (i) the displayed award enhancement trigger symbol and (ii) one or more enhanced award symbols, simultaneously moving in the same direction downwards or upwards in the display symbol column in which the expansion trigger symbol was presented.

16. The method of claim 11, wherein the one or more enhanced award symbols comprise one or more prize on symbols.

17. The method of claim 11, wherein the expansion trigger symbol is a wild symbol.

18. The method of claim 11, wherein the expansion trigger symbol is an award multiplier symbol.

19. The method of claim 11, wherein the expansion trigger symbol is a prize on symbol.

20. One or more non-transitory media having software stored thereon, the software including instructions for performing a method of controlling an electronic gaming device, the method comprising:

receiving, via a control system of the electronic gaming machine that includes one or more processors, an indication that one or more forms of monetary credit of monetary credit have been received by one or more components configured to receive the one or more of forms of monetary credit, the one or more forms of monetary credit including cash, a coin, a ticket, a credit card, a debit card, a patron account, a financial account, or a signal from a device associated with the receipt of monetary credit;

establishing, via the control system, a credit balance on the electronic gaming machine based on receiving the indication that one or more forms of monetary credit have been received, the credit balance being used to place one or more wagers on one or more instances of a slot game, and the credit balance being decreased by an amount associated with each of the one or more wagers during the one or more instances of the slot game;

determining a slot game outcome and corresponding display symbols that will be presented on a display system of the electronic gaming device for an instance of a slot game, the display symbols selected from a symbol set comprising expansion trigger symbols, award enhancement trigger symbols, and combination trigger symbols that function as both an expansion trigger symbol and an award enhancement trigger symbol;

controlling, via the control system, the display system to display selected display symbols for the slot game outcome at a plurality of display symbol positions on a display device of the display system, wherein the display symbol positions are arranged in a plurality of active display symbol rows and a plurality of active display symbol columns, and wherein at least one of the selected display symbols is a combination trigger symbol;

controlling, via the control system in response to displaying the combination trigger symbol, the display system to change the displayed combination trigger symbol to the expansion trigger symbol and thereby present the expansion trigger symbol;

controlling, via the control system, the display system to present at least one additional active display symbol position in a display symbol row or a display symbol column in which the expansion trigger symbol is displayed;

controlling, via the control system after presenting the at least one additional active display symbol position and in response to displaying the expansion trigger symbol, the display system to change the displayed expansion trigger symbol to the award enhancement trigger symbol and thereby present the award enhancement trigger symbol in at least one of the active display symbol positions; and controlling, via the control system, the display system to present one or more enhanced award symbols in a row or column of active display symbol positions in which the expansion trigger symbol was presented.

21. The gaming device of claim 20, the method further comprising:

receiving, via a user interface system configured for receiving a cash out indication by a player, a cash out indication by the player; and controlling, via the control system and in response to receiving the cash out indication by the player, one or more monetary credit dispensing components to provide monetary credit to the player.

22. The gaming device of claim 1, wherein:

the user interface system comprises a touch screen, and the indication of the player's initiation of one or more instances of the slot game is received via the touch screen.

23. The gaming device of claim 1, wherein:

the user interface system comprises one or more buttons, and the indication of the player's initiation of one or more instances of the slot game is received via the one or more buttons.

* * * * *